US011016404B2

(12) United States Patent
Sasaki et al.

(10) Patent No.: US 11,016,404 B2
(45) Date of Patent: May 25, 2021

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Tomoya Sasaki, Kanagawa (JP); Masahiro Iwasaki, Kanagawa (JP); Ryosuke Fujii, Kanagawa (JP); Wataru Yamada, Kanagawa (JP); Takahiro Ishizuka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/746,980

(22) Filed: Jan. 20, 2020

(65) Prior Publication Data

US 2021/0080843 A1 Mar. 18, 2021

(30) Foreign Application Priority Data

Sep. 17, 2019 (JP) ..... JP2019-168272

(51) Int. Cl.
*G03G 5/05* (2006.01)
*G03G 5/147* (2006.01)

(52) U.S. Cl.
CPC ..... *G03G 5/14726* (2013.01); *G03G 5/0539* (2013.01); *G03G 5/0546* (2013.01); *G03G 5/0592* (2013.01); *G03G 5/14786* (2013.01); *G03G 5/14791* (2013.01)

(58) Field of Classification Search
None
See application file for complete search history.

(56) References Cited

U.S. PATENT DOCUMENTS 4,792,507 A * 12/1988 Yoshihara ..... G03G 5/14786 430/59.6
5,637,142 A * 6/1997 Kubo ..... B29C 33/58 106/285
6,833,403 B1 * 12/2004 Bladel ..... C09D 127/18 524/458
2013/0115380 A1 * 5/2013 Zhang ..... B05D 5/083 427/485
2016/0231657 A1 * 8/2016 Miyamoto ..... G03G 5/0564

FOREIGN PATENT DOCUMENTS

| | | |
|---|---|---|
| JP | S63221355 | 9/1988 |
| JP | 2009-104145 | 5/2009 |
| JP | 4436456 | 3/2010 |
| JP | 2011-118054 | 6/2011 |
| JP | 5544850 | 7/2014 |

* cited by examiner

*Primary Examiner* — Christopher D Rodee
(74) *Attorney, Agent, or Firm* — JCIPRNET

(57) ABSTRACT

An electrophotographic photoreceptor includes a conductive substrate and a photosensitive layer disposed on the conductive substrate. An outermost surface layer of the electrophotographic photoreceptor contains a fluorine-based graft polymer and a fluorine-containing resin particle. The fluorine-based graft polymer includes at least a first structural unit that does not have an acidic group with a pKa of 3 or less but has a fluorine atom, a second structural unit derived from a macromonomer, and a third structural unit having the acidic group with a pKa of 3 or less.

18 Claims, 2 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2019-168272 filed Sep. 17, 2019.

BACKGROUND

(i) Technical Field

The present disclosure relates to an electrophotographic photoreceptor, a process cartridge, and an image forming apparatus.

(ii) Related Art

For the purpose of extending the life of an electrophotographic photoreceptor, recently, approaches have been studied to reduce surface energy of a surface layer of the electrophotographic photoreceptor by incorporating fluorine-based resin particles in the surface layer.

Japanese Unexamined Patent Application Publication No. 63-221355 discloses an electrophotographic photoreceptor including a conductive support and a photosensitive layer on the conductive support, in which a surface layer contains a fluorine-based resin powder and a fluorine-based graft polymer.

Japanese Patent No. 5544850 discloses an electrophotographic photoreceptor including a conductive support and at least a photosensitive layer on the conductive support, in which a surface layer contains fluorine-containing resin particles and a fluorine-based graft polymer that includes specific structural units, that has a fluorine content of 10% by mass or more and 40% by mass or less, that has a weight-average molecular weight Mw of 50,000 or more and 200,000 or less, that has a ratio [Mw/Mn] of the weight-average molecular weight Mw to the number-average molecular weight Mn of 1 or more and 8 or less, and that has a perfluoroalkyl group having 1 to 6 carbon atoms such that a content of the fluorine-based graft polymer is 0.5% by mass or more and 5.0% by mass or less relative to the fluorine-containing resin particles.

Japanese Patent No. 4436456 discloses an electrophotographic photoreceptor including a support and a photosensitive layer disposed on the support, in which a surface layer of the electrophotographic photoreceptor contains a fluorine-based graft polymer having a specific repeating structural unit having a perfluoroalkyl group with 4 to 6 carbon atoms, and fluorine atom-containing resin particles.

SUMMARY

Hitherto, in order to enhance the cleanability of an electrophotographic photoreceptor, fluorine-containing resin particles have been blended in a surface layer of the electrophotographic photoreceptor. In addition, for example, a dispersant such as a fluorine-based graft polymer has been used to enhance the dispersibility of the fluorine-containing resin particles.

However, in some combinations of the fluorine-containing resin particles and the fluorine-based graft polymer that are used, the absolute value of the potential on the surface of the electrophotographic photoreceptor is unlikely to be decreased by exposure. As a result, the potential may remain on the surface of the electrophotographic photoreceptor as a residual potential.

Aspects of non-limiting embodiments of the present disclosure relate to an electrophotographic photoreceptor that includes a conductive substrate and a photosensitive layer disposed on the conductive substrate, in which a residual potential is reduced compared to when an outermost surface layer of such an electrophotographic photoreceptor contains fluorine-containing resin particles and a fluorine-based graft polymer that does not have an acidic group with a pKa of 3 or less.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an electrophotographic photoreceptor including a conductive substrate and a photosensitive layer disposed on the conductive substrate. An outermost surface layer of the electrophotographic photoreceptor contains a fluorine-based graft polymer and a fluorine-containing resin particle. The fluorine-based graft polymer includes at least a first structural unit that does not have an acidic group with a pKa of 3 or less but has a fluorine atom, a second structural unit derived from a macromonomer, and a third structural unit having the acidic group with a pKa of 3 or less.

BRIEF DESCRIPTION OF THE DRAWINGS

Exemplary embodiments of the present disclosure will be described in detail based on the following figures, wherein.

DETAILED DESCRIPTION

Figure 1:
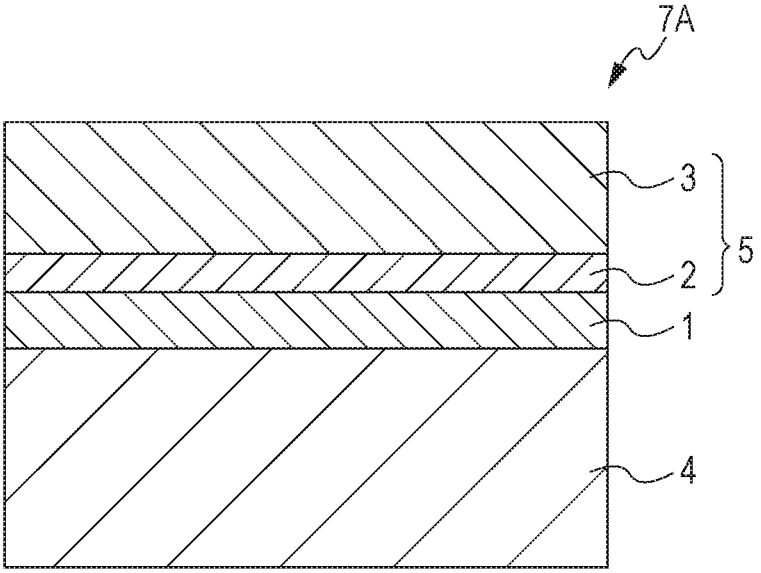
FIG. 1 is a schematic sectional view illustrating an example of a layer structure of an electrophotographic photoreceptor according to an exemplary embodiment.

Exemplary embodiments, which are examples of the present disclosure, will now be described in detail.

Electrophotographic Photoreceptor

An electrophotographic photoreceptor according to a first exemplary embodiment includes a conductive substrate, and a photosensitive layer disposed on the conductive substrate, in which an outermost surface layer of the electrophotographic photoreceptor contains a fluorine-based graft polymer and a fluorine-containing resin particle, and the fluorine-based graft polymer includes at least a first structural unit that does not have an acidic group with a pKa of 3 or less but has a fluorine atom, a second structural unit derived from a macromonomer, and a third structural unit having the acidic group with a pKa of 3 or less.

Hereinafter, an electrophotographic photoreceptor is also simply referred to as a "photoreceptor".

An electrophotographic photoreceptor according to a second exemplary embodiment includes a conductive substrate, and a photosensitive layer disposed on the conductive substrate, in which an outermost surface layer of the electrophotographic photoreceptor contains a fluorine-based graft polymer and a fluorine-containing resin particle, and the fluorine-based graft polymer includes at least a first structural unit that does not have an acidic group (Ac) which is at least one selected from the group consisting of a sulfo group, a phosphate group, a phosphonate group, and a fluorinated alkyl carboxy group but has a fluorine atom, a second structural unit derived from a macromonomer, and a third structural unit having the acidic group (Ac).

In the following description, a photoreceptor corresponding to at least one of the photoreceptor according to the first exemplary embodiment and the photoreceptor according to the second exemplary embodiment will be referred to as a "photoreceptor according to the exemplary embodiment". The photoreceptor according to the exemplary embodiment may be a photoreceptor corresponding to both the photoreceptor according to the first exemplary embodiment and the photoreceptor according to the second exemplary embodiment.

An acidic group corresponding to at least one of the "acidic group with a pKa of 3 or less" and the "acidic group (Ac)" is also referred to as a "specific acidic group".

A first structural unit does not have the specific acidic group and that has a fluorine atom is also referred to as a "first structural unit" or an "(a) first structural unit". A second structural unit derived from a macromonomer is also referred to as a "second structural unit" or a "(b) second structural unit". A third structural unit having the specific acidic group is also referred to as a "third structural unit" or a "(c) third structural unit".

A fluorine-based graft polymer including at least the (a) first structural unit, the (b) second structural unit, and the (c) third structural unit is also referred to as a "specific fluorine-based graft polymer" or an "(A) specific fluorine-based graft polymer". Fluorine-containing resin particles are also referred to as "(B) fluorine-containing resin particles".

According to the photoreceptor according to the exemplary embodiment, the residual potential is reduced by the configurations described above. The reason for this is presumably as follows.

Hitherto, in order to enhance cleanability of an electrophotographic photoreceptor, fluorine-containing resin particles have been blended in a surface layer of the electrophotographic photoreceptor. In addition, a dispersant such as a fluorine-based graft polymer is used to enhance dispersibility of the fluorine-containing resin particles.

However, in some combinations of the fluorine-containing resin particles and the fluorine-based graft polymer that are used, the absolute value of the potential on the surface of the electrophotographic photoreceptor is unlikely to be decreased by exposure. As a result, the potential may remain on the surface of the electrophotographic photoreceptor as a residual potential.

In contrast, an outermost surface layer of the photoreceptor according to the exemplary embodiment contains the (A) specific fluorine-based graft polymer and the (B) fluorine-containing resin particles. Since the (A) specific fluorine-based graft polymer has the specific acidic group in the (c) third structural unit, ionicity is exhibited to decrease the electrical resistance of the whole outermost surface layer. Consequently, the absolute value of the potential is easily decreased by exposure. As a result, in the photoreceptor according to the exemplary embodiment, the residual potential is considered to be reduced.

For the reasons described above, a photoreceptor in which the residual potential is reduced is presumably provided in the exemplary embodiment.

Since the (A) specific fluorine-based graft polymer includes the (a) first structural unit that does not have the specific acidic group but has a fluorine atom and the (b) second structural unit derived from a macromonomer, good dispersibility of the (B) fluorine-containing resin particles in the outermost surface layer is also achieved. Specifically, the (B) fluorine-containing resin particles in an outermost surface layer-forming coating liquid for forming the outermost surface layer have good dispersion stability. In addition, the (B) fluorine-containing resin particles in a coating film obtained by applying the outermost surface layer-forming coating liquid have good dispersibility. As a result, an outermost surface layer having good dispersibility of the (B) fluorine-containing resin particles is obtained.

Accordingly, the exemplary embodiment provides a photoreceptor in which the residual potential is reduced while dispersibility of the (B) fluorine-containing resin particles is achieved.

In particular, since the (A) specific fluorine-based graft polymer includes not only the (a) first structural unit and the (b) second structural unit but also the (c) third structural unit, dispersibility of the (B) fluorine-containing resin particles further improves. Although the reason for this is not clear, it is considered that when the (c) third structural unit has the specific acidic group, the dispersion stability of the (B) fluorine-containing resin particles in the coating liquid and the coating film is improved in the process of forming the outermost surface layer.

As described above, in the photoreceptor according to the exemplary embodiment, the absolute value of the potential on the surface of the photoreceptor is easily decreased by exposure. Therefore, the potential difference (that is, the contrast of the potential) between an exposed portion and a non-exposed portion is easily obtained, thus easily forming an image having a good image quality. In addition, since the absolute value of the potential on the surface of the photoreceptor is easily decreased by exposure, in addition to the residual potential at the initial stage of image formation, the accumulation of the residual potential is also suppressed when the image formation is performed over a long period of time.

Furthermore, in the exemplary embodiment, since the (A) specific fluorine-based graft polymer contains the specific acidic group, the (A) specific fluorine-based graft polymer is adsorbed and fixed on the surfaces of the (B) fluorine-containing resin particles in the coating film, and thus migration of the specific acidic group in the film is unlikely to occur. Therefore, the resulting outermost surface layer has a highly uniform electrical resistance. This suppresses changes in electrical properties of the photoreceptor with time due to abrasion of the surface by the use of the photoreceptor.

Hereafter, a photoreceptor according to the exemplary embodiment will be described in detail.

An outermost surface layer of the photoreceptor according to the exemplary embodiment contains a (A) specific fluorine-based graft polymer and (B) fluorine-containing resin particles.

For example, a charge transport layer, a protective layer, or a single-layer-type photosensitive layer corresponds to the outermost surface layer. The outermost surface layer may contain components other than the fluorine-based graft polymer and the fluorine-containing resin particles depending on the type of the layer. The other components will be described together with the structures of layers of the photoreceptor.

The outermost surface layer may optionally contain a fluorine-based graft polymer other than the (A) specific fluorine-based graft polymer. However, the content of the (A) specific fluorine-based graft polymer relative to the total of the fluorine-based graft polymers contained in the outermost surface layer is preferably 70% by mass or more, more preferably 80% by mass or more, still more preferably 90% by mass or more.

(A) Specific Fluorine-Based Graft Polymer

First, the (A) specific fluorine-based graft polymer will be described.

The (A) specific fluorine-based graft polymer is used for dispersing, for example, (B) fluorine-containing resin particles described later.

The (A) specific fluorine-based graft polymer includes at least the (a) first structural unit, the (b) second structural unit, and the (c) third structural unit. The (A) specific fluorine-based graft polymer may optionally further include another structural unit. However, a total content of the (a) first structural unit, the (b) second structural unit, and the (c) third structural unit in all structural units included in the (A) specific fluorine-based graft polymer is preferably 70% by mass or more, more preferably 85% by mass or more, still more preferably 90% by mass or more.

The (a) first structural unit, the (b) second structural unit, and the (c) third structural unit are obtained by, for example, a publicly known polymerization method (such as chain polymerization, polycondensation, or polyaddition). From the viewpoints of, for example, the availability of raw materials, the polymerization method, and the range of choices of the composition ratio control, the structural units are preferably those obtained by chain polymerization of compounds having unsaturated double bonds.

The (a) first structural unit, the (b) second structural unit, and the (c) third structural unit will now be described.

(a) First Structural Unit

The type of the structural unit of (a) is not limited as long as the structural unit does not have the acidic group but has a fluorine atom therein. The fluorine atom may replace any carbon atom but preferably replaces a carbon atom other than a carbon atom participating in polymerization reaction. Furthermore, the fluorine atom is preferably present as a perfluoroalkyl group having 6 or less carbon atoms, the perfluoroalkyl group being bound to an atom forming the main chain of the specific fluorine-based graft polymer through an optional linking group.

An example of the (a) first structural unit is a structural unit represented by general formula (1) below.

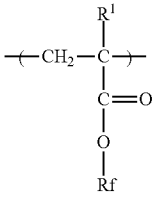

(1)

In general formula (1), $R^1$ represents a hydrogen atom or an alkyl group, and Rf represents an organic group having a fluorine atom.

$R^1$ is preferably a hydrogen atom or an alkyl group having 1 to 6 carbon atoms, more preferably a hydrogen atom, a methyl group, an ethyl group, or a propyl group, still more preferably a hydrogen atom or a methyl group, particularly preferably a methyl group.

The organic group having a fluorine atom and represented by Rf represents a structure that essentially contains a carbon atom and a fluorine atom and that may further contain, for example, a hydrogen atom and an oxygen atom. Examples of the oxygen atom contained in the organic group having a fluorine atom include an oxygen atom contained as a hydroxy group and an oxygen atom contained as an ether bond. A preferred form of the organic group having a fluorine atom is a structure that essentially contains a carbon atom and a fluorine atom and that may further contain a hydrogen atom and an oxygen atom of an ether bond (that is, "—O—").

Specific examples of the organic group having a fluorine atom include fluorinated alkyl groups, fluorinated alkyl groups having a hydroxy group, fluorinated alkyloxy fluorinated alkylene groups, and poly(fluorinated alkyleneoxy) groups.

The total number of carbon atoms of the organic group having a fluorine atom is, for example, 15 or less, preferably 12 or less. The number of fluorine atoms contained in the organic group having a fluorine atom is preferably 5 or more and 20 or less, more preferably 7 or more and 18 or less.

The chemical formula weight of the (a) first structural unit is preferably 150 or more and 600 or less, more preferably 200 or more and 550 or less, still more preferably 250 or more and 500 or less.

(b) Second Structural Unit

The (b) second structural unit is a structural unit derived from a macromonomer.

Here, the macromonomer refers to a polymerizable monomer having a polymerizable group and a high molecular weight (for example, a molecular weight of 300 or more). The macromonomer has, for example, a polymer chain represented by a repeating structure. Examples of the macromonomer include linear high-molecular compounds having a polymerizable functional group at one end of the molecular chain thereof.

By copolymerizing a macromonomer which is a precursor of the (b) second structural unit with a monomer which is a precursor of the (a) first structural unit and a monomer which is a precursor of the (c) third structural unit, a graft (comb-shaped) polymer is formed.

The type of the (b) second structural unit is not limited as long as the structural unit has a polymer chain represented by a repeating structure as a graft chain extending from the main chain of the specific fluorine-based graft polymer. Examples of the graft chain include poly(meth)acrylates, polystyrene, polyalkyleneoxy, and polysiloxane.

An example of the (b) second structural unit is a structural unit represented by general formula (2) below.

(2)

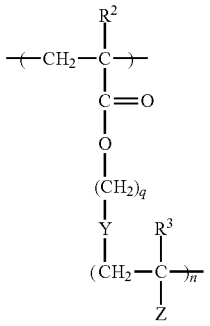

In general formula (2), n represents an integer of 2 or more, q represents an integer of 1 or more, $R^2$ and $R^3$ each independently represent a hydrogen atom or an alkyl group, Y represents a substituted or unsubstituted alkylene group, —O—, —NH—, —S—, —C(=O)—, a divalent linking group obtained by combining any of these, or a single bond, and Z represents a group represented by general formula (2A) or (2B) described later.

In general formula (2), n is an integer of 2 or more, preferably an integer of 2 or more and 500 or less, more preferably an integer of 2 or more and 200 or less, still more preferably an integer of 10 or more and 100 or less.

In general formula (2), q is an integer of 1 or more, preferably 1 or more and 10 or less, more preferably 1 or more and 5 or less.

$R^2$ and $R^3$ in general formula (2) are each independently preferably a hydrogen atom or an alkyl group having 1 to 6 carbon atoms, more preferably a hydrogen atom, a methyl group, an ethyl group, or a propyl group, still more preferably a hydrogen atom or a methyl group.

Y in general formula (2) is preferably a substituted or unsubstituted alkylene group, —O—, —S—, —O—C(=O)—, —C(=O)—O—, —NH—C(=O)—, —C(=O)—NH—, or a divalent linking group obtained by combining any of these, more preferably an unsubstituted alkylene group, a hydroxy-substituted alkylene group, a cyano group-substituted alkylene group, an alkyl-substituted alkylene group, —S—, —O—C(=O)—, —C(=O)—O—, —NH—C(=O)—, —C(=O)—NH—, or a divalent linking group obtained by combining any of these, still more preferably an unsubstituted alkylene group, a hydroxy-substituted alkylene group, —S—, —O—C(=O)—, —C(=O)—O—, or a divalent linking group obtained by combining any of these.

The number of carbon atoms of the substituted or unsubstituted alkylene group is, for example, 1 or more and 10 or less, preferably 1 or more and 5 or less, more preferably 1 or more and 3 or less.

Examples of the substituent for the substituted alkylene group include alkyl groups having 4 or less carbon atoms, halogen atoms, a hydroxy group, lower alkoxy groups having 4 or less carbon atoms, an ester group, and a cyano group.

(2A)

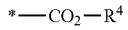

(2B)

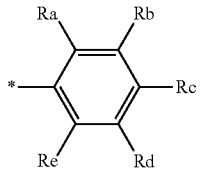

In general formula (2A), $R^4$ represents a substituted or unsubstituted alkyl group or a mono- or poly-alkyleneoxy chain, and * represents a site bound to a carbon atom.

In general formula (2B), Ra to Re each independently represent a hydrogen atom, an alkyl group having 4 or less carbon atoms, or an alkoxy group having 4 or less carbon atoms, and * represents a site bound to a carbon atom.

Examples of the substituent for the substituted alkyl group represented by $R^4$ in general formula (2A) include halogen atoms, a hydroxy group, lower alkoxy groups having 4 or less carbon atoms, and an ester group.

Examples of the alkyleneoxy chain represented by $R^4$ in general formula (2A) include an ethyleneoxy chain and propyleneoxy chain. The number of repetitions of the alkyleneoxy chain is, for example, 6 or less, preferably 4 or less. Examples of the group at an end of the alkyleneoxy chain include a hydroxy group and alkoxy groups having 4 or less carbon atoms.

$R^4$ in general formula (2A) is preferably an alkyl group having 8 or less carbon atoms or an alkyleneoxy chain having a number of repetitions of 4 or less, more preferably an alkyl group having 4 or less carbon atoms or an ethyleneoxy chain or propyleneoxy chain having a number of repetitions of 2 or less.

Ra to Re in general formula (2B) are each independently preferably a hydrogen atom, a methyl group, an ethyl group, a n-propyl group, or a methoxy group, more preferably a hydrogen atom, a methyl group, or a methoxy group.

Z in general formula (2) is preferably a group represented by general formula (2A).

The (b) second structural unit may be a structural unit other than the structural unit represented by general formula (2) above.

For example, when the (b) second structural unit is a chain polymerization-type repeating unit, the (b) second structural unit may be a structural unit represented by general formula (2X) below. In this case, the chemical formula weight of the (b) second structural unit is, for example, 1,000 or more and 30,000 or less, preferably 2,000 or more and 20,000 or less, more preferably 3,000 or more and 10,000 or less.

Another example of the (b) second structural unit is a structural unit represented by general formula (2Y) below (that is, a vinyl ether structural unit).

For example, when the (b) second structural unit is a polycondensation-type repeating unit, the (b) second structural unit may be, for example, a structural unit in which a structure represented by general formula (2C) below substitutes a side chain of a diol, a dicarboxylic acid, or a dicarboxylic acid derivative.

(2X)

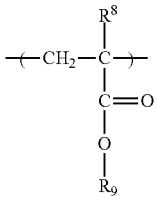

(2Y)

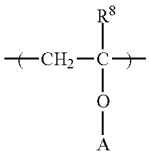

In general formulae (2X) and (2Y), $R^8$ has the same definition as in $R^2$ in general formula (2) above.

In general formula (2X), $R^9$ represents a group having a polyalkyleneoxy chain or a polysiloxane chain.

In general formula (2Y), A represents the structure represented by general formula (2C) below.

(2C)

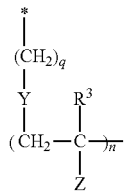

In general formula (2C), q, Y, $R^3$, n, and Z have the same definition as in q, Y, $R^3$, n, and Z, respectively, in general formula (2), and * represents a site bound to an oxygen atom.

Next, a method for synthesizing a macromonomer which is a precursor of the (b) second structural unit will be described.

An example of the method for synthesizing the macromonomer which is a precursor of the (b) second structural unit includes initiating polymerization such as chain polymerization or polycondensation by using a compound having a functional group such as a carboxy group or a hydroxy group to synthesize a polymer having, at one end, a functional group such as a carboxy group or a hydroxy group, and introducing a polymerizable group on the basis of this functional group to obtain a macromonomer having a polymerizable group at one end.

For example, when the (b) second structural unit is the structural unit represented by general formula (2) above, polymerization of a (meth)acrylic compound or a styrene compound is initiated by using a radical polymerization initiator or a chain transfer agent having a functional group such as a carboxy group or a hydroxy group to synthesize a (meth)acrylic polymer or a styrene polymer having, at one end, a functional group such as a carboxy group or a hydroxy group, and a radical-polymerizable group (for example, a (meth)acrylic group) is introduced on the basis of this functional group to obtain a macromonomer corresponding to the precursor of the structural unit represented by general formula (2). Examples of the detailed method for synthesizing a macromonomer include the methods described in Japanese Unexamined Patent Application Publication Nos. 58-164656 and 60-133007.

The chemical formula weight of the (b) second structural unit is preferably 1,000 or more and 30,000 or less, more preferably 2,000 or more and 20,000 or less, still more preferably 3,000 or more and 10,000 or less.

(c) Third Structural Unit

The type of the (c) third structural unit is not limited as long as the structural unit has the specific acidic group.

The pKa of the specific acidic group is known from, for example, literature data of model compounds having the specific acidic group or measurement using a publicly known method such as titration. Examples of the specific acidic group include a sulfo group (methanesulfonic acid: −2.6), a phosphonate group (first dissociation: 1.5), a phosphate group (first dissociation: 2.12), and a fluorinated alkyl carboxy group (for example, trifluoroacetic acid: −0.25, difluoroacetic acid: 1.24, and monofluoroacetic acid: 2.66). In the parentheses, specific examples of the compounds or the dissociation stage, and literature data of pKa are shown.

An example of the (c) third structural unit is a structural unit represented by general formula (3) below.

(3)

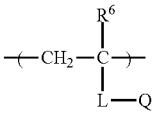

In general formula (3), L represents a substituted or unsubstituted alkylene group, —O—, —C(=O)—, —$NR^{10}$—, —$C_6H_4$—, a divalent linking group obtained by combining any of these, or a single bond, Q represents a sulfo group, a phosphonate group, a phosphate group, or a fluorinated alkyl carboxy group, and $R^6$ represents a hydrogen atom, a halogen atom, or an alkyl group. $R^{10}$ represents a hydrogen atom or a substituted or unsubstituted alkyl group.

L in general formula (3) is preferably a substituted or unsubstituted alkylene group, —O—, —C(=O)O—, —C(=O)$NR^{10}$—, —$C_6H_4$—, a divalent linking group obtained by combining any of these, or a single bond, more preferably a substituted or unsubstituted alkylene group, —C(=O)O—, —C(=O)$NR^{10}$—, —$C_6H_4$—, or a divalent linking group obtained by combining any of these. In particular, —C(=O)O—, —C(=O)$NR^{10}$—, and —$C_6H_4$— are each preferably bound directly to the carbon atom C in general formula (3) from the viewpoint of polymerizability.

Examples of the substituent for the substituted alkylene group represented by L in general formula (3) include the same as those in the substituted alkylene group represented by Y in general formula (2). However, the substituted alkylene group represented by L in general formula (3) preferably does not have a fluorine atom.

Examples of the substituent for the substituted alkyl group represented by $R^{10}$ include the same as those in the substituted alkyl group represented by $R^4$ in general formula (2A).

When L in general formula (3) includes —$C_6H_4$—, the —$C_6H_4$— may be positioned at the ortho-position, the meta-position, or the para position. Of these, the meta-position or the para position is preferred.

Specific examples of L in general formula (3) include, besides a single bond, linking groups represented by general formulae (L-1) to (L-3) below.

(L-1)

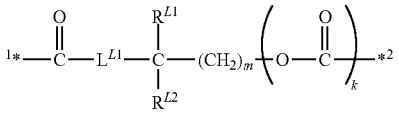

(L-2)

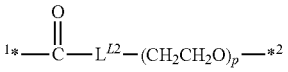

(L-3)

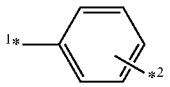

In general formulae (L-1) to (L-3) above, $L^{L1}$ and $L^{L2}$ represent —O— or —NH—, $R^{L1}$ and $R^{L2}$ each independently represent a hydrogen atom or a methyl group, m represents an integer of 1 or more and 5 or less, k represents 0 or 1, p represents an integer of 2 or more and 10 or less, $^{1}*$ represents a site directly bound to the carbon atom of general formula (3), and $*^{2}$ represents a site directly bound to Q of general formula (3).

In general formulae (L-1) to (L-3), $L^{L1}$ and $L^{L2}$ are preferably —O—, m is preferably an integer of 2 or more and 3 or less, and p is preferably an integer of 4 or more and 6 or less. When Q in general formula (3) is a sulfo group, a phosphonate group, or a phosphate group, k in general formula (L-1) is preferably 0. When Q in general formula (3) is a fluorinated alkyl carboxy group, k in general formula (L-1) is preferably 1.

The sulfo group represented by Q in general formula (3) is represented by $—SO_3H$, the phosphonate group is represented by $—P(=O)(OH)_r(OR^{11})_{2-r}$, the phosphate group is represented by $—OP(=O)(OH)_s(OR^{12})_{2-s}$, and the fluorinated alkyl carboxy group is represented by $—(CF_zH_{(2-z)})_y—CO_2H$. Here, r and s each independently represent 1 or 2, z represents 1 or 2, and y represents an integer of 1 or more and 5 or less (preferably an integer of 1 or more and 3 or less). $R^{11}$ and $R^{12}$ each independently have the same definition as in $R^{10}$ above.

Q in general formula (3) is not limited as long as the conditions described above are satisfied. From the viewpoints of the availability of raw materials and the molecular design, a sulfo group, a phosphate group, or a fluorinated alkyl carboxy group is suitable.

$R^6$ in general formula (3) is preferably a hydrogen atom, a fluorine atom, or an alkyl group having 1 to 6 carbon atoms.

When the fluorinated alkyl carboxy group represented by Q in general formula (3) is directly bound to an alkylene group of the group represented by L in general formula (3), a group extending to, among carbon atoms to which a fluorine atom is bound, the carbon atom that is farthest from the carboxy group is considered as the group represented by Q, and an alkylene group constituted by only carbon atoms having no fluorine atom is considered to be included in the group represented by L.

In the (c) third structural unit, an example of a structural unit other than the structural unit represented by general formula (3) is a structural unit in which both a fluorine atom and a carboxy group are directly bound to one carbon atom constituting the main chain. When both a fluorine atom and a carboxy group are directly bound to one carbon atom, the carboxy group functions as the specific acidic group with a pKa of 3 or less.

The chemical formula weight of the (c) third structural unit is preferably 80 or more and 600 or less, more preferably 90 or more and 550 or less, still more preferably 100 or more and 500 or less.

Specific Examples of Structural Units

Specific examples of the structural unit represented by general formula (1) are shown in Tables 1 and 2 below but are not limited thereto.

TABLE 1

| | $R^1$ | Rf |
|---|---|---|
| Formula (1-1) | —H | $—CH_2CF_3$ |
| Formula (1-2) | $—CH_3$ | $—CH_2CF_3$ |
| Formula (1-3) | —H | $—CH_2C_2F_5$ |
| Formula (1-4) | $—CH_3$ | $—CH_2C_2F_5$ |
| Formula (1-5) | $—CH_3$ | $—CH_2(CF_2)_2CF_3$ |
| Formula (1-6) | —H | $—CH(CF_3)_2$ |
| Formula (1-7) | $—CH_3$ | $—CH(CF_3)_2$ |
| Formula (1-8) | —H | $—CH_2CH_2(CF_2)_3CF_3$ |
| Formula (1-9) | $—CH_3$ | $—CH_2CH_2(CF_2)_3CF_3$ |
| Formula (1-10) | —H | $—CH_2(CF_2)_3CF_2H$ |
| Formula (1-11) | $—CH_3$ | $—CH_2(CF_2)_3CF_2H$ |
| Formula (1-12) | —H | $—CH_2CH(OH)CH_2(CF_2)_3CF_3$ |
| Formula (1-13) | $—CH_3$ | $—CH_2CH(OH)CH_2(CF_2)_3CF_3$ |
| Formula (1-14) | —H | $—CH_2CH(OH)CH_2(CF_2)_2CF(CF_3)_2$ |
| Formula (1-15) | $—CH_3$ | $—CH_2CH(OH)CH_2(CF_2)_2CF(CF_3)_2$ |

TABLE 2

| | $R^1$ | Rf |
|---|---|---|
| Formula (1-16) | —H | $—CH_2CH_2(CF_2)_5CF_3$ |
| Formula (1-17) | $—CH_3$ | $—CH_2CH_2(CF_2)_5CF_3$ |
| Formula (1-18) | —H | $—CH_2(CF_2)_5CF_2H$ |
| Formula (1-19) | $—CH_3$ | $—CH_2(CF_2)_5CF_2H$ |
| Formula (1-20) | —H | $—CH_2CH(OH)CH_2(CF_2)_5CF_3$ |
| Formula (1-21) | $—CH_3$ | $—CH_2CH(OH)CH_2(CF_2)_5CF_3$ |
| Formula (1-22) | —H | $—CH_2(CF_2)_8CF_3$ |
| Formula (1-23) | —H | $—CH_2CH_2(CF_2)_7CF_3$ |
| Formula (1-24) | $—CH_3$ | $—CH_2CH_2(CF_2)_7CF_3$ |
| Formula (1-25) | —H | $—CH_2CF(CF_3)—O—(CF_2)_2CF_3$ |
| Formula (1-26) | —H | $—CH_2CF(CF_3)—O—CF_2CF(CF_3)—O—(CF_2)_2CF_3$ |

Specific examples of the structural unit represented by general formula (2) are shown in Tables 3 and 4 below but are not limited thereto.

The notation of the linking group represented by Yin the tables below means that the left end portion of the linking group is bound to the carbon atom close to the main chain, and the right end portion of the linking group is bound to the carbon atom apart from the main chain.

TABLE 3

| | $R^2$ | q | Y | $R^3$ | Z | n |
|---|---|---|---|---|---|---|
| Formula (2-1) | —H | 2 | —O—C(═O)—$CH_2$—S— | —$CH_3$ | —$CO_2$—$CH_3$ | 50 |
| Formula (2-2) | —H | 2 | —NH—C(═O)—O—$(CH_2)_2$—S— | —$CH_3$ | —$CO_2$—$CH_3$ | 50 |
| Formula (2-3) | —$CH_3$ | 2 | —NH—C(═O)—O—$(CH_2)_2$—S— | —$CH_3$ | —$CO_2$—$CH_3$ | 50 |
| Formula (2-4) | —$CH_3$ | 2 | —O—$(CH_2)_2$—NH—C(═O)—O—$(CH_2)_2$—S— | —$CH_3$ | —$CO_2$—$CH_3$ | 40 |
| Formula (2-5) | —$CH_3$ | 1 | —C(═O)—O—$(CH_2)_2$—S— | —$CH_3$ | —$CO_2$—$CH_3$ | 60 |
| Formula (2-6) | —H | 2 | —C(═O)—O—$(CH_2)_2$—S— | —$CH_3$ | —$CO_2$—$CH_3$ | 70 |
| Formula (2-7) | —$CH_3$ | 1 | —CH(OH)—$CH_2$—O—C(═O)—$(CH_2)_2$—C($CH_2$)(CN)— | —$CH_3$ | —$CO_2$—$CH_3$ | 60 |
| Formula (2-8) | —H | 2 | —C(═O)—O—$(CH_2)_2$—NH—C(═O)—C$(CH_2)_2$— | —$CH_3$ | —$CO_2$—$CH_3$ | 60 |
| Formula (2-9) | —H | 2 | —O—C(═O)—$CH_2$—S— | —$CH_3$ | —$CO_2$—$CH_3$ | 40 |
| Formula (2-10) | —$CH_3$ | 2 | —O—C(═O)—$CH_2$—S— | —$CH_3$ | —$CO_2$—$CH_3$ | 50 |
| Formula (2-11) | —H | 2 | —C(═O)—O—$(CH_2)_2$—S— | —$CH_3$ | —$CO_2$—$CH_3$ | 70 |
| Formula (2-12) | —H | 1 | —CH(OH)—$CH_2$—O—C(═O)—$CH_2$—S— | —$CH_3$ | —$CO_2$—$CH_3$ | 60 |
| Formula (2-13) | —$CH_3$ | 1 | —CH(OH)—$CH_2$—O—C(═O)—$CH_2$—S— | —$CH_3$ | —$CO_2$—$CH_3$ | 30 |
| Formula (2-14) | —$CH_3$ | 1 | —CH(OH)—$CH_2$—O—C(═O)—$CH_2$—S— | —$CH_3$ | —$CO_2$—$CH_3$ | 60 |
| Formula (2-15) | —$CH_3$ | 1 | —CH(OH)—$CH_2$—O—C(═O)—$CH_2$—S— | —$CH_3$ | —$CO_2$—$C_2H_5$ | 70 |

TABLE 4

| | $R^2$ | q | Y | $R^3$ | Z | n |
|---|---|---|---|---|---|---|
| Formula (2-16) | —$CH_3$ | 1 | —CH(OH)—$CH_2$—O—C(═O)—$CH_2$—S— | —H | —$CO_2$—n$C_4H_9$ | 60 |
| Formula (2-17) | —$CH_3$ | 1 | —CH(OH)—$CH_2$—O—C(═O)—$(CH_2)_2$—S— | —$CH_3$ | —$CO_2$—$CH_3$ | 50 |
| Formula (2-18) | —$CH_3$ | 1 | —CH(OH)—$CH_2$—O—C(═O)—$(CH_2)_2$—S— | —H | —$CO_2$—$CH_3$ | 60 |
| Formula (2-19) | —$CH_3$ | 1 | —CH(OH)—$CH_2$—O—C(═O)—$(CH_2)_2$—S— | —$CH_3$ | —$CO_2$—$CH_3$ | 60 |
| Formula (2-20) | —$CH_3$ | 1 | —CH(OH)—$CH_2$—O—C(═O)—$(CH_2)_2$—S— | —$CH_3$ | —$CO_2$—$CH_3$ | 80 |
| Formula (2-21) | —$CH_3$ | 1 | —CH(OH)—$CH_2$—O—C(═O)—$(CH_2)_2$—S— | —H | —$CO_2$—n$C_4H_9$ | 60 |
| Formula (2-22) | —$CH_3$ | 1 | —CH(OH)—$CH_2$—O—C(═O)—$CH_2$—S— | —H | —$C_6H_5$ | 60 |
| Formula (2-23) | —$CH_3$ | 1 | —CH(OH)—$CH_2$—O—C(═O)—$(CH_2)_2$—S— | —H | —$C_6H_5$ | 60 |
| Formula (2-24) | —$CH_3$ | 1 | —CH(OH)—$CH_2$—O—C(═O)—$(CH_2)_2$—S— | —$CH_3$ | —$CO_2$—$CH_2CH_2$—$OCH_3$ | 50 |
| Formula (2-25) | —H | 4 | —O—C(═O)—$(CH_2)_2$—S— | —$CH_3$ | —$CO_2$—$CH_3$ | 70 |

Specific examples of the structural unit represented by general formula (3) are shown in Tables 5 and 6 below but are not limited thereto.

The notation of the linking group represented by L in the tables below means that the left end portion of the linking group is bound to the carbon atom constituting the main chain, and the right end portion of the linking group is bound to the group represented by Q in general formula (3).

TABLE 5

| | $R^6$ | L | Q | Type of acidic group |
|---|---|---|---|---|
| Formula (3-1) | —H | Single bond | —$SO_3H$ | Sulfo group |
| Formula (3-2) | —H | Single bond | —P(═O)$(OH)_2$ | Phosphonate group |
| Formula (3-3) | —$CH_3$ | —C(═O)—O—$(CH_2)_2$— | —$SO_3H$ | Sulfo group |
| Formula (3-4) | —$CH_3$ | —C(═O)—O—$(CH_2)_3$— | —$SO_3H$ | Sulfo group |
| Formula (3-5) | —H | —C(═O)—O—$(CH_2)_3$— | —$SO_3H$ | Sulfo group |
| Formula (3-6) | —H | —$C_5H_4$— (Para-position) | —$SO_3H$ | Sulfo group |
| Formula (3-7) | —H | —C(═O)—NH—C$(CH_3)_2$—$CH_2$— | —$SO_3H$ | Sulfo group |
| Formula (3-8) | —$CH_3$ | —C(═O)—O—$(CH_2)_2$— | —P(═O)$(OH)_2$ | Phosphonate group |
| Formula (3-9) | —H | —C(═O)—O—$(CH_2)_2$— | —OP(═O)$(OH)_2$ | Phosphate group |
| Formula (3-10) | —$CH_3$ | —C(═O)—O—$(CH_2)_2$— | —OP(═O)$(OH)_2$ | Phosphate group |
| Formula (3-11) | —$CH_3$ | —C(═O)—O—$(CH_2CH_2$—$O)_x$— x: 4 or 5 | —P(═O)$(OH)_2$ | Phosphonate group |
| Formula (3-12) | —$CH_3$ | —C(═O)—O—$(CH_2CH(CH_3)$—$O)_x$— x: 5 or 6 | —P(═O)$(OH)_2$ | Phosphonate group |
| Formula (3-13) | —H | —C(═O)—O—$(CH_2)_2$—O—C(═O)— | —$(CF_2)_2$—$CO_2H$ | Fluorinated alkyl carboxy group |

TABLE 5-continued

| | $R^6$ | L | Q | Type of acidic group |
|---|---|---|---|---|
| Formula (3-14) | —$CH_3$ | —C(=O)—O—$(CH_2)_2$—O—C(=O)— | —$(CF_2)_2$—$CO_2H$ | Fluorinated alkyl carboxy group |
| Formula (3-15) | —H | —C(=O)—O—$(CH_2)_2$—O—C(=O)— | —$(CF_2)_2$—$CO_2H$ | Fluorinated alkyl carboxy group |

TABLE 6

| | $R^6$ | L | Q | Type of acidic group |
|---|---|---|---|---|
| Formula (3-16) | —$CH_3$ | —C(=O)—O—$(CH_2)_2$—O—C(=O)— | —$(CF_2)_3$—$CO_2H$ | Fluorinated alkyl carboxy group |
| Formula (3-17) | —H | —C(=O)—O—$CH_2CH(CH_3)$—O—C(=O)— | —$(CF_2)_2$—$CO_2H$ | Fluorinated alkyl carboxy group |
| Formula (3-18) | —$CH_3$ | —C(=O)—O—$CH_2CH(CH_3)$—O—C(=O)— | —$(CF_2)_2$—$CO_2H$ | Fluorinated alkyl carboxy group |
| Formula (3-19) | —H | —C(=O)—O—$CH_2CH(CH_3)$—O—C(=O)— | —$(CF_2)_3$—$CO_2H$ | Fluorinated alkyl carboxy group |
| Formula (3-20) | —$CH_3$ | —C(=O)—O—$CH_2CH(CH_3)$—O—C(=O)— | —$(CF_2)_3$—$CO_2H$ | Fluorinated alkyl carboxy group |

In the (a) first structural unit, specific examples other than formulae (1-1) to (1-26) cited as specific examples of the structural unit represented by general formula (1) include the following.

(a-1)

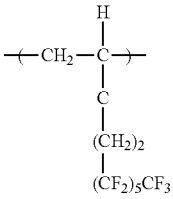

(a-2)

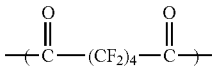

(a-3)

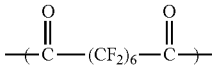

In the (b) second structural unit, specific examples other than formulae (2-1) to (2-25) cited as specific examples of the structural unit represented by general formula (2) include the following.

(b-1)

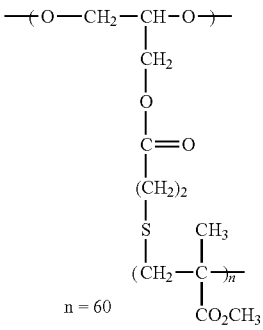

-continued (b-2)

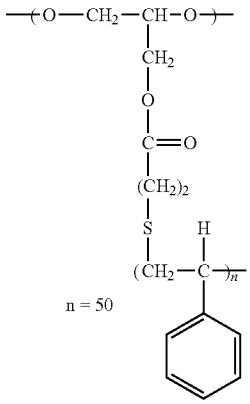

(b-3)

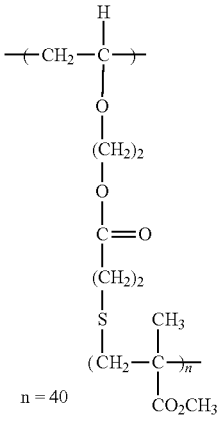

In the (c) third structural unit, specific examples other than formulae (3-1) to (3-20) cited as specific examples of the structural unit represented by general formula (3) include the following.

(c-1)

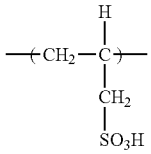

(c-2)

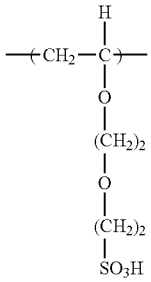

(c-3)

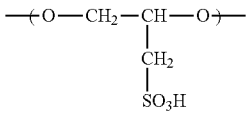

(c-4)

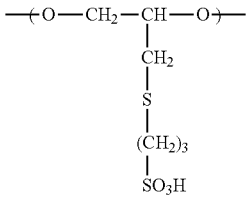

(c-5)

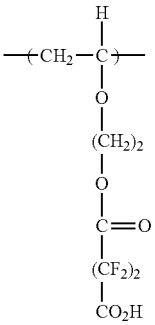

(c-6)

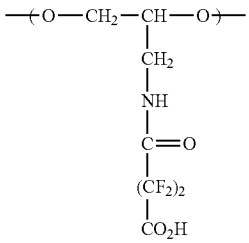

(c-7)

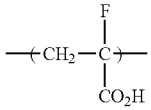

Other Structural Units

As described above, the (A) specific fluorine-based graft polymer may further include another structural unit in addition to the (a) first structural unit, the (b) second structural unit, and the (c) third structural unit. When the (a) first structural unit, the (b) second structural unit, and the (c) third structural unit are the structural unit represented by general formula (1), the structural unit represented by general formula (2), and the structural unit represented by general formula (3), respectively, the other structural unit is, for example, a structural unit represented by general formula (4) below.

(4)

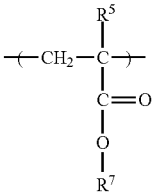

In general formula (4), $R^5$ represents a hydrogen atom or an alkyl group, and $R^7$ represents a substituted or unsubstituted alkyl group.

$R^5$ is preferably a hydrogen atom or an alkyl group having 1 to 6 carbon atoms.

Examples of the substituent for the substituted alkyl group represented by $R^7$ in general formula (4) include a hydroxy group, an alkoxy group, an aryl group, or an ester group.

$R^7$ is preferably an alkyl group having 30 or less carbon atoms, an alkyl group substituted with a hydroxy group, or an alkyl group substituted with an alkoxy group having 10 or less carbon atoms, an aryl group, or an ester group, more preferably an alkyl group having 20 or less carbon atoms or an alkyl group substituted with an alkoxy group having 4 or less carbon atoms, an aryl group, or an ester group.

Synthesis and Identification of Specific Fluorine-Based Graft Polymer

Next, an example of a method for synthesizing the (A) specific fluorine-based graft polymer will be described.

When the (A) specific fluorine-based graft polymer is constituted by the structural unit represented by general formula (1), the structural unit represented by general formula (2), and the structural unit represented by general formula (3), the specific fluorine-based graft polymer is synthesized by, for example, chain polymerization of compounds having unsaturated double bonds derived from the respective structural units (specifically, compounds in which a carbon-carbon bond in the main chain of each structural unit is replaced with an unsaturated double bond, that is, monomers which are precursors of the respective structural units). Examples of the chain polymerization include radical polymerization and anionic polymerization. The radical polymerization and anionic polymerization are achieved by heating as required in the presence of a radical polymerization initiator and an anionic polymerization initiator, respectively.

When the (A) specific fluorine-based graft polymer is constituted by structural units other than the structural units represented by general formulae (1) to (3), for example, constituted by structural units selected from those represented by (a-1) to (a-3), (b-1) to (b-3), and (C-1) to (c-6) above, an increase in the molecular weight may be achieved by cationic polymerization of vinyl ethers or polyesterification by polycondensation between a diol and a dicarboxylic acid or dicarboxylic acid derivative. The increase in the molecular weight may be achieved by heating as required in the presence of a cationic polymerization initiator in the case of cationic polymerization or in the presence of a catalyst or a condensing agent in the case of polycondensation.

Alternatively, it is possible to employ, as needed, a method including protecting or neutralizing the specific acidic group in the (c) third structural unit in advance, performing polymerization, and after the increase in the molecular weight, performing deprotection or returning to be acidic to produce the specific acidic group.

The structures and the contents of structural units of a fluorine-based graft polymer are analyzed by, for example, an infrared absorption spectrum (IR spectrum) and a nuclear magnetic resonance spectrum (NMR spectrum).

In the case where an IR spectrum, an NMR spectrum, and the like of a fluorine-based graft polymer are measured from the outermost surface layer containing the fluorine-based graft polymer, the fluorine-based graft polymer which is a measurement sample may be collected as follows.

Specifically, the outermost surface layer is dissolved in a dissolving solvent such as tetrahydrofuran, and fluorine-containing resin particles are filtered with a 0.1 μm mesh filter. Next, the fluorine-containing resin particles obtained by filtration are heated at 100° C. or lower in one solvent or a mixture of two or more solvents selected from aromatic hydrocarbons such as toluene and xylene, halogen solvents such as fluorocarbons, perfluorocarbons, hydrochlorofluorocarbons, methylene chloride, and chloroform, ester solvents such as ethyl acetate and butyl acetate, and ketone solvents such as acetone, methyl ethyl ketone, methyl isobutyl ketone, and cyclopentanone, subsequently filtered, and dried to collect the fluorine-based graft polymer that has been adsorbed on the surfaces of the fluorine-containing resin particles by elution.

Contents of Structural Units

The numbers of the (a) first structural units, the (b) second structural units, and the (c) third structural units that are contained in the (A) specific fluorine-based graft polymer are each an integer of 1 or more, preferably an integer of 5 or more and 300 or less, more preferably an integer of 10 or more and 200 or less.

When the (A) specific fluorine-based graft polymer includes the structural unit represented by general formula (1), the structural unit represented by general formula (2), and the structural unit represented by general formula (3), the numbers of the structural units are each an integer of 1 or more, preferably an integer of 5 or more and 300 or less, more preferably an integer of 10 or more and 200 or less.

When the total molar amount of the (a) first structural unit, the (b) second structural unit, and the (c) third structural unit that are contained in the (A) specific fluorine-based graft polymer is assumed to be 100% by mole, the molar ratio of the (a) first structural unit is preferably 20% by mole or more and 95% by mole or less, more preferably 40% by mole or more and 90% by mole or less. The molar ratio of the (c) third structural unit is preferably 1% by mole or more and 30% by mole or less, more preferably 2% by mole or more and 20% by mole or less.

When the (A) specific fluorine-based graft polymer includes the structural unit represented by general formula (1), the structural unit represented by general formula (2), and the structural unit represented by general formula (3), the content of the structural unit represented by general formula (1) is preferably 20% by mole or more and 95% by mole or less, more preferably 40% by mole or more and 90% by mole or less relative to the total number of moles of the structural unit represented by general formula (1), the structural unit represented by general formula (2), and the structural unit represented by general formula (3). The content of the structural unit represented by general formula (3) is preferably 1% by mole or more and 30% by mole or less, more preferably 2% by mole or more and 20% by mole or less relative to the total number of moles of the structural unit represented by general formula (1), the structural unit represented by general formula (2), and the structural unit represented by general formula (3).

When the (A) specific fluorine-based graft polymer further includes another structural unit in addition to the (a) first structural unit, the (b) second structural unit, and the (c) third structural unit, the molar ratio of the other structural unit is preferably 30% by mole or less, more preferably 15% by mole or less where the total molar amount of the (a) first structural unit, the (b) second structural unit, the (c) third structural unit, and the other structural unit is assumed to be 100% by mole.

When the (A) specific fluorine-based graft polymer includes the structural unit represented by general formula (1), the structural unit represented by general formula (2), the structural unit represented by general formula (3), and the structural unit represented by general formula (4), which is another structural unit, the content of the structural unit represented by general formula (4) is preferably 30% by mole or less, more preferably 15% by mole or less relative to the total number of moles of the structural unit represented by general formula (1), the structural unit represented by general formula (2), the structural unit represented by general formula (3), and the structural unit represented by general formula (4).

Properties and Specific Examples of Specific Fluorine-Based Graft Polymer

The acid value of the (A) specific fluorine-based graft polymer is preferably 0.1 mgKOH/g or more and 50 mgKOH/g or less, more preferably 0.2 mgKOH/g or more and 30 mgKOH/g or less, most preferably 0.3 mgKOH/g or more and 20 mgKOH/g or less. When the acid value of the (A) specific fluorine-based graft polymer is within the above range, the effect of decreasing the absolute value of the photoreceptor potential after exposure is easily obtained compared with the case where the acid value is lower than the above range. When the acid value of the (A) specific fluorine-based graft polymer is within the above range, a difficulty of charging due to an excessively low resistance of the surface layer of the photoreceptor is unlikely to occur, and the occurrence of the dark decay of the potential after charging is suppressed compared with the case where the acid value is higher than the above range.

The weight-average molecular weight Mw and the number-average molecular weight Mn of the (A) specific fluorine-based graft polymer refer to values in terms of polystyrene as measured by gel permeation chromatography.

The weight-average molecular weight Mw of the (A) specific fluorine-based graft polymer is preferably 40,000 or more and 400,000 or less, more preferably 50,000 or more and 300,000 or less. A polydispersity index represented by Mw/Mn is preferably 1 or more and 8 or less, more preferably 1 or more and 6 or less.

The content of the (A) specific fluorine-based graft polymer in the outermost surface layer is preferably 0.5 parts by mass or more and 10 parts by mass or less, more preferably 1 part by mass or more and 7 parts by mass or less relative to 100 parts by mass of the (B) fluorine-containing resin particles.

The number of moles of the specific acidic group contained in the (A) specific fluorine-based graft polymer is preferably 0.2 μmol/g or more and 5 μmol/g or less, more preferably 0.3 μmol/g or more and 4 μmol/g or less per 1 g of the (B) fluorine-containing resin particles.

(A) Specific fluorine-based graft polymers may be used alone or in combination of two or more polymers. When two or more (A) specific fluorine-based graft polymers are used, the content and the number of moles of the specific acidic group each mean the total of the two or more (A) specific fluorine-based graft polymers.

Specific examples of the (A) specific fluorine-based graft polymer are shown in Tables 7 and 8 below but are not limited thereto.

TABLE 7

| (A) Specific fluorine-based graft polymer | (a) First structural unit | (b) Second structural unit | (c) Third structural unit | Molar ratio (a) | (b) | (c) | Acid value mgKOH/g | Weight-average molecular weight Mw |
|---|---|---|---|---|---|---|---|---|
| A-1 | Formula (1-1) | Formula (2-1) | Formula (3-3) | 0.95 | 0.04 | 0.01 | 1.61 | 150,000 |
| A-2 | Formula (1-3) | Formula (2-6) | Formula (3-6) | 0.95 | 0.04 | 0.01 | 1.18 | 140,000 |
| A-3 | Formula (1-5) | Formula (2-12) | Formula (3-7) | 0.92 | 0.05 | 0.03 | 3.04 | 90,000 |
| A-4 | Formula (1-8) | Formula (2-13) | Formula (3-10) | 0.88 | 0.07 | 0.05 | 5.61 | 70,000 |
| A-5 | Formula (1-14) | Formula (2-14) | Formula (3-11) | 0.88 | 0.07 | 0.05 | 3.55 | 100,000 |
| A-6 | Formula (1-16) | Formula (2-16) | Formula (3-12) | 0.88 | 0.07 | 0.05 | 3.01 | 110,000 |
| A-7 | Formula (1-17) | Formula (2-19) | Formula (3-14) | 0.88 | 0.07 | 0.05 | 3.44 | 70,000 |
| A-8 | Formula (1-22) | Formula (2-20) | Formula (3-15) | 0.88 | 0.07 | 0.05 | 2.87 | 120,000 |
| A-9 | Formula (1-23) | Formula (2-23) | (c-7) | 0.88 | 0.07 | 0.05 | 3.12 | 60,000 |
| A-10 | Formula (1-26) | Formula (2-24) | Formula (3-1) | 0.88 | 0.07 | 0.05 | 2.86 | 60,000 |
| A-11 | Formula (1-17) | Formula (2-19) | Formula (3-6) | 0.88 | 0.07 | 0.05 | 3.47 | 80,000 |
| A-12 | Formula (1-8) | Formula (2-16) | Formula (3-4) | 0.88 | 0.07 | 0.05 | 3.39 | 130,000 |
| A-13 | Formula (1-16) | Formula (2-23) | Formula (3-10) | 0.88 | 0.07 | 0.05 | 3.44 | 70,000 |
| A-14 | Formula (1-23) | Formula (2-14) | Formula (3-3) | 0.88 | 0.07 | 0.05 | 3.17 | 50,000 |
| A-15 | Formula (1-17) | Formula (2-3) | Formula (3-7) | 0.88 | 0.07 | 0.05 | 3.79 | 70,000 |

TABLE 8

| (A) Specific fluorine-based graft polymer | (a) First structural unit | (b) Second structural unit | (c) Third structural unit | Molar ratio (a) | (b) | (c) | Acid value mgKOH/g | Weight-average molecular weight Mw |
|---|---|---|---|---|---|---|---|---|
| A-16 | Formula (1-9) | Formula (2-23) | Formula (3-3) | 0.88 | 0.07 | 0.05 | 3.79 | 90,000 |
| A-17 | Formula (1-16) | Formula (2-19) | Formula (3-3) | 0.8 | 0.193 | 0.007 | 0.26 | 170,000 |
| A-18 | Formula (1-16) | Formula (2-19) | Formula (3-3) | 0.8 | 0.19 | 0.01 | 0.38 | 180,000 |
| A-19 | Formula (1-16) | Formula (2-19) | Formula (3-3) | 0.75 | 0.15 | 0.1 | 4.55 | 150,000 |
| A-20 | Formula (1-16) | Formula (2-19) | Formula (3-3) | 0.75 | 0.1 | 0.15 | 8.93 | 80,000 |
| A-21 | Formula (1-16) | Formula (2-19) | Formula (3-3) | 0.73 | 0.07 | 0.2 | 14.69 | 60,000 |
| A-22 | Formula (1-17) | Formula (2-23) | Formula (3-6) | 0.88 | 0.07 | 0.05 | 3.39 | 80,000 |
| A-23 | (a-1) | (b-3) | (c-2) | 0.84 | 0.12 | 0.04 | 2.75 | 120,000 |
| A-24 | (a-1) | (b-3) | (c-5) | 0.84 | 0.11 | 0.05 | 3.59 | 100,000 |
| A-25 | (a-3) | (b-2) | (c-4) | 0.5 | 0.3 | 0.2 | 6.28 | 70,000 |
| A-26 | (a-2) | (b-2) | (c-6) | 0.5 | 0.3 | 0.2 | 6.44 | 60,000 |

(B) Fluorine-Containing Resin Particles

Examples of the (B) fluorine-containing resin particles include particles of a fluoroolefin homopolymer and particles of a copolymer of two or more monomers, the copolymer being a copolymer of one or two or more fluoroolefins and a fluorine-free monomer (that is, a monomer having no fluorine atom).

Examples of the fluoroolefin include perhaloolefins such as tetrafluoroethylene (TFE), perfluorovinyl ether, hexafluoropropylene (HFP), chlorotrifluoroethylene (CTFE), and dichlorodifluoroethylene; and non-perfluoroolefins such as vinylidene fluoride (VdF), trifluoroethylene, and vinyl fluoride. Of these, for example, VdF, TFE, CTFE, and HFP are preferred.

On the other hand, examples of the fluorine-free monomer include hydrocarbon olefins such as ethylene, propylene, and butene; alkyl vinyl ethers such as cyclohexyl vinyl ether (CHVE), ethyl vinyl ether (EVE), butyl vinyl ether, and methyl vinyl ether; alkenyl vinyl ethers such as polyoxyethylene allyl ether (POEAE) and ethyl allyl ether; organosilicon compounds having an active α,β-unsaturated group, such as vinyltrimethoxysilane (VSi), vinyltriethoxysilane, and vinyltris(methoxyethoxy)silane; acrylic acid esters such as methyl acrylate and ethyl acrylate; methacrylic acid esters such as methyl methacrylate and ethyl methacrylate; and vinyl esters such as vinyl acetate, vinyl benzoate, and "VeoVa" (trade name, vinyl ester manufactured by Shell). Of these, alkyl vinyl ethers, allyl vinyl ether, vinyl esters, and organosilicon compounds having an active α,β-unsaturated group are preferred.

Of these, particles having a high fluorination rate are preferred as the (B) fluorine-containing resin particles. Particles of polytetrafluoroethylene (PTFE), polyvinylidene fluoride (PVDF), tetrafluoroethylene-hexafluoropropylene copolymers (FEP), tetrafluoroethylene-perfluoro(alkylvinyl ether) copolymers (PFA), ethylene-tetrafluoroethylene copolymers (ETFE), ethylene-chlorotrifluoroethylene copolymers (ECTFE), and the like are more preferred, particles of PTFE, PVDF, FEP, and PFA are still more preferred, and particles of PTFE and PVDF are particularly preferred.

Examples of the (B) fluorine-containing resin particles include particles obtained by being irradiated with radiation (herein, also referred to as "radiation irradiation-type fluorine-containing resin particles") and particles obtained by a polymerization method (herein, also referred to as "polymerization-type fluorine-containing resin particles").

The radiation irradiation-type fluorine-containing resin particles (fluorine-containing resin particles obtained by being irradiated with radiation) refer to fluorine-containing resin particles that are formed into particles along with radiation polymerization and fluorine-containing resin particles obtained by irradiating a fluorine-containing resin after polymerization with radiation to decompose the resin, thereby reducing the molecular weight and the size of the particles.

The radiation irradiation-type fluorine-containing resin particles include a large number of carboxy groups because a carboxylic acid is generated in a large amount by radiation irradiation in air. The generation of the carboxylic acid is considered to be caused because a radical generated by decomposition of the main chain of the fluorine-containing resin due to radiation irradiation in air reacts with oxygen in air.

On the other hand, the polymerization-type fluorine-containing resin particles (fluorine-containing resin particles obtained by a polymerization method) refer to fluorine-containing resin particles that are formed into particles along with polymerization by, for example, a suspension polymerization method or an emulsion polymerization method and that are not irradiated with radiation.

The polymerization-type fluorine-containing resin particles are produced by polymerization in the presence of a basic compound, and therefore, the fluorine-containing resin particles contain the basic compound as a residue.

An example of the method for producing fluorine-containing resin particles by suspension polymerization includes suspending additives such as a polymerization initiator and a catalyst in a dispersion medium together with a monomer for forming a fluorine-containing resin, and subsequently forming particles of a polymerized product while polymerizing the monomer.

An example of the method for producing fluorine-containing resin particles by emulsion polymerization includes emulsifying additives such as a polymerization initiator and a catalyst in a dispersion medium together with a monomer for forming a fluorine-containing resin by using a surfactant (that is, an emulsifier), and subsequently forming particles of a polymerized product while polymerizing the monomer.

Fluorine-containing resin particles including a large number of carboxy groups exhibit ionic conductivity and thus have a property of being unlikely to be charged.

Therefore, when such fluorine-containing resin particles including a large number of carboxy groups are contained in an outermost surface layer of an electrophotographic photoreceptor, the chargeability of the photoreceptor decreases in a high-temperature, high-humidity environment, which may result in the phenomenon in which a toner adheres to a non-image area (hereinafter also referred to as "fogging").

In addition, when fluorine-containing resin particles include a large number of carboxy groups, the dispersibility tends to decrease. This is probably because the affinity of the fluorine atom-containing structural unit of the specific fluorine-based graft polymer to the fluorine-containing resin particles decreases.

Therefore, when such fluorine-containing resin particles including a large number of carboxy groups are contained in an outermost surface layer of an electrophotographic photoreceptor, the cleanability tends to decrease locally.

Accordingly, the number of carboxy groups in the (B) fluorine-containing resin particles is preferably 0 or more and 30 or less per $10^6$ carbon atoms.

The number of carboxy groups in the (B) fluorine-containing resin particles is more preferably 0 or more and 20 or less per $10^6$ carbon atoms from the viewpoints of suppressing a local decrease in cleanability and suppressing the fogging.

Here, examples of the carboxy groups of the (B) fluorine-containing resin particles include carboxy groups derived from terminal carboxylic acids included in the fluorine-containing resin particles.

Examples of the method for reducing the number of carboxy groups of the (B) fluorine-containing resin particles include (1) a method in which radiation irradiation is not performed in the process of producing the particles and (2) a method in which radiation irradiation is performed in the absence of oxygen or in a decreased oxygen concentration (for example, in an inert gas such as nitrogen).

The number of carboxy groups of the (B) fluorine-containing resin particles is measured as follows in accordance with, for example, the method described in Japanese Unexamined Patent Application Publication No. 4-20507.

The (B) fluorine-containing resin particles are pre-formed by a press machine to prepare a film having a thickness of 0.1 mm. An infrared absorption spectrum of the prepared film is measured. The (B) fluorine-containing resin particles are brought into contact with fluorine gas to prepare fluorine-containing resin particles whose carboxylic acid terminals have been completely fluorinated. An infrared absorption spectrum of the resulting fluorine-containing resin particles is also measured. The number of terminal carboxy groups per $10^6$ carbon atoms is calculated from a difference spectrum between the two spectra by the following formula.

$$\text{The number of terminal carboxy groups (per } 10^6 \text{ carbon atoms)} = (1 \times K)/t \qquad \text{Formula:}$$

l: Absorbance

K: Correction coefficient t: Film thickness (mm)

The absorption wavenumber of carboxy groups is assumed to be 3,560 $cm^{-1}$, and the correction coefficient of carboxy groups is assumed to be 440.

In the (B) fluorine-containing resin particles, the amount of perfluorooctanoic acid (hereinafter also referred to as "PFOA") is preferably 0 ppb or more and 25 ppb or less, preferably 0 ppb or more and 20 ppb or less, more preferably 0 ppb or more and 15 ppb or less relative to the (B) fluorine-containing resin particles from the viewpoint of suppressing a local decrease in cleanability. Note that "ppb" is on a mass basis.

During the process of producing fluorine-containing resin particles (in particular, fluorine-containing resin particles such as polytetrafluoroethylene particles, modified polytetrafluoroethylene particles, and perfluoroalkyl ether/tetrafluoroethylene copolymer particles), PFOA may be used or generated as a by-product, and thus the resulting fluorine-containing resin particles often contain PFOA.

When PFOA is present, the fluorine-containing resin particles in the state of a coating liquid for forming a surface layer is considered to have a high dispersibility due to the fluorine-based graft polymer serving as a fluorine-containing dispersant. However, when the state of the coating liquid changes, (specifically, after the application of the coating liquid, when the concentrations of components in the resulting coating film change in drying of the coating film), the state of the fluorine-based graft polymer adhering to the fluorine-containing resin particles may be changed. Specifically, a part of the fluorine-based graft polymer is considered to be separated from the fluorine-containing resin particles due to PFOA. Therefore, the dispersibility of the fluorine-containing resin particles decreases, resulting in aggregation of the fluorine-containing resin particles. Consequently, a local decrease in the cleanability tends to occur.

An example of the method for reducing the amount of PFOA is a method that includes sufficiently washing fluorine-containing resin particles with, for example, pure water, alkaline water, an alcohol (such as methanol, ethanol, or isopropanol), a ketone (such as acetone, methyl ethyl ketone, or methyl isobutyl ketone), an ester (such as ethyl acetate), or another common organic solvent (such as toluene or tetrahydrofuran). Washing may be conducted at room temperature. However, washing under heating enables the amount of PFOA to be efficiently reduced.

The amount of PFOA is a value measured by the following method.

Pretreatment of Sample

When the amount of PFOA is measured from an outermost surface layer that contains fluorine-containing resin particles, the outermost surface layer is immersed in a solvent (for example, tetrahydrofuran) to dissolve substances other than the fluorine-containing resin particles and substances that are insoluble in the solvent (for example, tetrahydrofuran), the resulting solution is then added to pure water dropwise, and the resulting precipitate is separated by filtration. The solution obtained at this time and containing PFOA is collected. The insoluble matter obtained by filtration is further dissolved in a solvent, the resulting solution is then added to pure water dropwise, and the resulting precipitate is separated by filtration. The solution obtained at this time and containing PFOA is collected. This operation of collecting the solution containing PFOA is repeated five times. The aqueous solution collected in all the operations is used as a pretreated aqueous solution.

When the amount of PFOA is measured from fluorine-containing resin particles themselves, the fluorine-containing resin particles are subjected to the same treatment as that in the case of a layer product to prepare a pretreated aqueous solution.

Measurement

A sample solution is prepared by using the pretreated aqueous solution obtained by the method described above. Adjustment and measurement of the sample solution are performed in accordance with the method described in "Analysis of Perfluorooctanesulfonic Acid (PFOS) and Perfluorooctanoic Acid (PFOA) in Environmental Water, Sediment, and Living Organisms, by Research Institute for Environmental Sciences and Public Health of Iwate Prefecture".

The average secondary particle size of the (B) fluorine-containing resin particles is not particularly limited but is preferably 0.2 μm or more and 4.5 μm or less, more preferably 0.2 μm or more and 4 μm or less. Fluorine-containing resin particles (in particular, fluorine-containing resin particles such as PTFE particles) having an average secondary particle size of 0.2 μm or more and 4.5 μm or less tend to contain PFOA in a large amount. Therefore, the fluorine-containing resin particles having an average secondary particle size of 0.2 μm or more and 4.5 μm or less particularly tend to have low dispersibility. However, when the amount of PFOA is suppressed to be within the above range, even such fluorine-containing resin particles having an average secondary particle size of 0.2 μm or more and 4.5 μm or less have enhanced dispersibility.

The average primary particle size of the (B) fluorine-containing resin particles is freely selected within the range that achieves desired photoreceptor properties and is not particularly limited. The average primary particle size of the (B) fluorine-containing resin particles is preferably 0.05 μm or more and 1 μm or less, more preferably 0.1 μm or more and 0.5 μm or less.

When the average primary particle size is 0.05 μm or more, aggregation in dispersion is further suppressed. On the other hand, when the average primary particle size is 1 μm or less, image defects are further suppressed.

The average primary particle size and the average secondary particle size of the (B) fluorine-containing resin particles are values measured by the following method.

Fluorine-containing resin particles are observed with a scanning electron microscope (SEM) at a magnification of, for example, 5,000 or more, and the maximum sizes of fluorine-containing resin particles (primary particles or secondary particles formed by agglomeration of primary particles) are measured. The average determined from the maximum sizes of 50 particles measured as described above is defined as the average particle size (the average primary particle size or the average secondary particle size) of the fluorine-containing resin particles. The SEM used is JSM-6700F manufactured by JEOL Ltd., and a secondary electron image at an accelerating voltage of 5 kV is observed.

The weight-average molecular weight of the (B) fluorine-containing resin particles is freely selected within the range that achieves desired photoreceptor properties and is not particularly limited.

The specific surface area (BET specific surface area) of the (B) fluorine-containing resin particles is preferably 5 $m^2/g$ or more and 15 $m^2/g$ or less, more preferably 7 $m^2/g$ or more and 13 $m^2/g$ or less from the viewpoint of dispersion stability.

The specific surface area is a value measured by a nitrogen substitution method with a BET specific surface area analyzer (FlowSorb II 2300, manufactured by SHIMADZU CORPORATION).

The apparent density of the (B) fluorine-containing resin particles is preferably 0.2 g/mL or more and 0.5 g/mL or less, more preferably 0.3 g/mL or more and 0.45 g/mL or less from the viewpoint of dispersion stability.

The apparent density is a value measured in accordance with JIS K6891 (1995).

The melting temperature of the (B) fluorine-containing resin particles is preferably 300° C. or higher and 340° C. or lower, more preferably 325° C. or higher and 335° C. or lower.

The melting temperature is the melting point measured in accordance with JIS K6891 (1995).

The content of the (B) fluorine-containing resin particles is preferably 1% by mass or more and 30% by mass or less, more preferably 3% by mass or more and 20% by mass or less, still more preferably 5% by mass or more and 15% by mass or less relative to the total solid content of the outermost surface layer.

The (B) fluorine-containing resin particles may be one type or two or more types. When two or more types of particles are used as the (B) fluorine-containing resin particles, the above content of the (B) fluorine-containing resin particles means the total content of the two or more types of particles.

Hole-Transporting Material

The outermost surface layer contains at least the (A) specific fluorine-based graft polymer and the (B) fluorine-containing resin particles and further preferably contains a hole-transporting material. When the outermost surface layer contains a hole-transporting material, the effect of suppressing the residual potential is further enhanced.

Specifically, first, fluorine atoms present in the (A) specific fluorine-based graft polymer adsorb on the surfaces of the (B) fluorine-containing resin particles, and acid-base interaction occurs between the specific acidic group present in the (A) specific fluorine-based graft polymer and the hole-transporting material. As a result, the compatibility of the (B) fluorine-containing resin particles and the hole-transporting material improves with the (A) specific fluorine-based graft polymer therebetween. This improves dispersion stability of the (B) fluorine-containing resin particles in an outermost surface layer-forming coating liquid for forming the outermost surface layer and a coating film formed from the outermost surface layer-forming coating liquid. In addition, ionicity is exhibited by the acid-base interaction to decrease the resistance of the outermost surface layer. Thus, the photoreceptor potential after exposure is easily decreased. Furthermore, the specific acidic group is fixed to the (A) specific fluorine-based graft polymer that has been adsorbed to the (B) fluorine-containing resin particles and is unlikely to move in the outermost surface layer. Therefore, the outermost surface layer has a highly uniform film resistance. This suppresses changes in electrical properties with time, the changes being caused by abrasion of the outermost surface due to use.

As described above, for example, a charge transport layer, a protective layer, or a single-layer-type photosensitive layer corresponds to the outermost surface layer. In the case where the outermost surface layer contains a hole-transporting material, the type, the content, and the like of the preferred hole-transporting material vary depending on the type of the outermost surface layer. Therefore, they will be described together with the structures of the layers.

An electrophotographic photoreceptor according to the exemplary embodiment will now be described with reference to the drawings.

An electrophotographic photoreceptor 7A illustrated in FIG. 1 has a structure in which, for example, an undercoat layer 1, a charge generation layer 2, and a charge transport layer 3 are stacked on a conductive substrate 4 in this order. In the electrophotographic photoreceptor 7A, the charge generation layer 2 and the charge transport layer 3 constitute a photosensitive layer 5.

The electrophotographic photoreceptor 7A may have a layer structure that does not include the undercoat layer 1.

Alternatively, the electrophotographic photoreceptor 7A may be a photoreceptor including a single-layer-type photosensitive layer in which the functions of the charge generation layer 2 and the charge transport layer 3 are integrated. In the case of the photoreceptor including the single-layer-type photosensitive layer, the single-layer-type photosensitive layer constitutes the outermost surface layer.

Alternatively, the electrophotographic photoreceptor 7A may be a photoreceptor including a surface protection layer disposed on the charge transport layer 3 or the single-layer-type photosensitive layer. In the case of the photoreceptor including the surface protection layer, the surface protection layer constitutes the outermost surface layer.

The layers of the electrophotographic photoreceptor according to the exemplary embodiment will now be described in detail. In the description below, reference signs are omitted.

Conductive Substrate

Examples of the conductive substrate include metal plates, metal drums, and metal belts that contain a metal (such as aluminum, copper, zinc, chromium, nickel, molybdenum, vanadium, indium, gold, or platinum) or an alloy (such as stainless steel). Examples of the conductive substrate further include paper sheets, resin films, and belts coated, vapor-deposited, or laminated with a conductive compound (for example, a conductive polymer or indium oxide), a metal (for example, aluminum, palladium, or gold), or an alloy. Herein, "conductive" means that the volume resistivity is less than $10^{13}$ Ω·cm.

The surface of the conductive substrate may be roughened to have a center-line average roughness Ra of 0.04 μm or more and 0.5 μm or less in order to suppress interference fringes generated when the electrophotographic photoreceptor is used in a laser printer and is irradiated with a laser beam. When incoherent light is used as a light source, roughening of the surface for preventing interference fringes is not necessarily performed. However, roughening of the surface suppresses generation of defects due to irregularities on the surface of the conductive substrate and thus is suitable for further extending the lifetime.

Examples of the method for roughening the surface include wet honing with which an abrasive suspended in water is sprayed onto a conductive substrate, centerless grinding with which a conductive substrate is pressed against a rotating grinding stone to perform continuous grinding, and anodic oxidation treatment.

Another example of the method for roughening the surface is a method that includes, instead of roughening the surface of a conductive substrate, dispersing a conductive or semi-conductive powder in a resin, and forming a layer of the resulting resin on a surface of a conductive substrate to form a rough surface by the particles dispersed in the layer.

The surface roughening treatment by anodic oxidation includes anodizing a metal (for example, aluminum) conductive substrate serving as the anode in an electrolyte solution to thereby form an oxide film on the surface of the conductive substrate. Examples of the electrolyte solution include a sulfuric acid solution and an oxalic acid solution. However, a porous anodized film formed by anodic oxidation is chemically active in this state, is likely to be contaminated, and has resistivity that significantly varies depending on the environment. Therefore, the porous anodized film may be subjected to a pore-sealing treatment in which fine pores in the oxide film are sealed by volume expansion caused by hydration reaction in pressurized water vapor or boiling water (a metal salt such as a nickel salt may be added) so as to convert the oxide into a more stable hydrous oxide.

The thickness of the anodized film is preferably, for example, 0.3 μm or more and 15 μm or less. When the film thickness is within this range, a barrier property against injection tends to be exhibited, and a rise in the residual potential caused by repeated use tends to be suppressed.

The conductive substrate may be subjected to a treatment with an acidic treatment solution or a Boehmite treatment.

The treatment with an acidic treatment solution is conducted, for example, as follows. First, an acidic treatment solution containing phosphoric acid, chromic acid, and hydrofluoric acid is prepared. Regarding the blend ratio of phosphoric acid, chromic acid, and hydrofluoric acid in the acidic treatment solution, preferably, for example, phosphoric acid is in the range of from 10% by mass or more and 11% by mass or less, chromic acid is in the range of from 3% by mass or more and 5% by mass or less, hydrofluoric acid is in the range of from 0.5% by mass or more and 2% by mass or less, and the total concentration of these acids is preferably in the range of from 13.5% by mass or more and 18% by mass or less. The treatment temperature is preferably, for example, 42° C. or higher and 48° C. or lower. The resulting film preferably has a thickness of 0.3 μm or more and 15 μm or less.

The Boehmite treatment is conducted, for example, by immersing a conductive substrate in pure water at 90° C. or higher and 100° C. or lower for 5 to 60 minutes or by bringing a conductive substrate into contact with heated water vapor at 90° C. or higher and 120° C. or lower for 5 to 60 minutes. The resulting film preferably has a thickness of 0.1 μm or more and 5 μm or less. The resulting conductive substrate after the Boehmite treatment may be further anodized by using an electrolyte solution having a low film solubility, such as a solution of adipic acid, boric acid, a borate, a phosphate, a phthalate, a maleate, a benzoate, a tartrate, or a citrate.

Undercoat Layer

The undercoat layer is, for example, a layer that contains inorganic particles and a binder resin.

Examples of the inorganic particles include inorganic particles having a powder resistivity (volume resistivity) of $10^2$ Ω·cm or more and $10^{11}$ Ω·cm or less.

As the inorganic particles having the above resistivity, for example, metal oxide particles such as tin oxide particles, titanium oxide particles, zinc oxide particles, and zirconium oxide particles are preferred, and zinc oxide particles are particularly preferred.

The specific surface area of the inorganic particles as measured by the BET method may be, for example, 10 $m^2/g$ or more.

The volume-average particle size of the inorganic particles may be, for example, 50 nm or more and 2,000 nm or less (preferably 60 nm or more and 1,000 nm or less).

The content of the inorganic particles is, for example, preferably 10% by mass or more and 80% by mass or less, more preferably 40% by mass or more and 80% by mass or less relative to the binder resin.

The inorganic particles may be subjected to a surface treatment. The inorganic particles may be used as a mixture of two or more types of inorganic particles subjected to different surface treatments or a mixture of two or more types of inorganic particles having different particle sizes.

Examples of the surface treatment agent include silane coupling agents, titanate-based coupling agents, aluminum-based coupling agents, and surfactants. In particular, silane coupling agents are preferred, and amino-group-containing silane coupling agents are more preferred.

Examples of the amino-group-containing silane coupling agents include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopr- opyltriethoxysilane.

Silane coupling agents may be used as a mixture of two or more thereof. For example, an amino-group-containing silane coupling agent and another silane coupling agent may be used in combination. Examples of the other silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method with a surface treatment agent may be any publicly known method and, for example, may be a dry method or a wet method.

The treatment amount of the surface treatment agent is preferably, for example, 0.5% by mass or more and 10% by mass or less relative to the inorganic particles.

Here, the undercoat layer may contain an electron-accepting compound (acceptor compound) along with the inorganic particles from the viewpoint of enhancing long-term stability of electrical properties and carrier blocking properties.

Examples of the electron-accepting compound include electron-transporting substances such as quinone compounds, e.g., chloranil and bromanil; tetracyanoquinodimethane compounds; fluorenone compounds, e.g., 2,4,7-trinitrofluorenone and 2,4,5,7-tetranitro-9-fluorenone; oxadiazole compounds, e.g., 2-(4-biphenyl)-5-(4-tert-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds, e.g., 3,3',5,5'-tetra-tert-butyldiphenoquinone.

In particular, the electron-accepting compound is preferably a compound having an anthraquinone structure. Preferred examples of the compound having an anthraquinone structure include hydroxyanthraquinone compounds, aminoanthraquinone compounds, and aminohydroxyanthraquinone compounds. Specifically, for example, anthraquinone, alizarin, quinizarin, anthrarufin, and purpurin are preferred.

The electron-accepting compound may be contained in the undercoat layer in a state of being dispersed along with the inorganic particles or in a state of adhering to the surfaces of the inorganic particles.

Examples of the method for causing the electron-accepting compound to adhere to the surfaces of the inorganic particles include a dry method and a wet method.

An example of the dry method is a method with which, while inorganic particles are stirred with a mixer or the like that applies a large shear stress, an electron-accepting compound is added dropwise or sprayed along with dry air or nitrogen gas either directly or in the form of an organic solvent solution to cause the electron-accepting compound to adhere to the surfaces of the inorganic particles. The dropwise addition or spraying of the electron-accepting compound may be conducted at a temperature equal to or lower than the boiling point of the solvent. After the dropwise addition or spraying of the electron-accepting compound, baking may be further conducted at 100° C. or higher. The temperature and time for baking are not particularly limited as long as electrophotographic properties are obtained.

An example of the wet method is a method with which, while inorganic particles are dispersed in a solvent by stirring, by applying ultrasonic waves, or by using a sand mill, an attritor, a ball mill, or the like, an electron-accepting compound is added, and stirred or dispersed, and the solvent is then removed to cause the electron-accepting compound to adhere to the surfaces of the inorganic particles. Examples of the method for removing the solvent include filtration and distillation. After the removal of the solvent, baking may be further conducted at 100° C. or higher. The temperature and time for baking are not particularly limited as long as electrophotographic properties are obtained. In the wet method, water contained in the inorganic particles may be removed before the addition of the electron-accepting compound. Examples of the method for removing the water include a method for removing the water under stirring and heating in the solvent, and a method for removing the water by azeotropy with the solvent.

The adhesion of the electron-accepting compound may be conducted either before or after the inorganic particles are subjected to the surface treatment with the surface treatment agent. Alternatively, the adhesion of the electron-accepting compound and the surface treatment with the surface treatment agent may be conducted at the same time.

The content of the electron-accepting compound may be, for example, 0.01% by mass or more and 20% by mass or less and is preferably 0.01% by mass or more and 10% by mass or less relative to the inorganic particles.

Examples of the binder resin used in the undercoat layer include publicly known materials such as publicly known polymer compounds, e.g., acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organotitanium compounds; and silane coupling agents.

Examples of the binder resin used in the undercoat layer further include charge-transporting resins having charge-transporting groups, and conductive resins (such as polyaniline).

Of these, a resin that is insoluble in the coating solvent of the overlying layer is suitable as the binder resin used in the undercoat layer. Examples of the particularly suitable resin include thermosetting resins such as urea resins, phenolic resins, phenol-formaldehyde resins, melamine resins, urethane resins, unsaturated polyester resins, alkyd resins, and epoxy resins; and resins obtained by a reaction between a curing agent and at least one resin selected from the group consisting of polyamide resins, polyester resins, polyether resins, methacrylic resins, acrylic resins, polyvinyl alcohol resins, and polyvinyl acetal resins.

When two or more of these binder resins are used in combination, the mixing ratio is determined as necessary.

The undercoat layer may contain various additives to improve electrical properties, environmental stability, and image quality.

Examples of the additives include publicly known materials such as electron-transporting pigments formed of polycyclic condensed compounds, azo compounds, or the like, zirconium chelate compounds, titanium chelate compounds, aluminum chelate compounds, titanium alkoxide compounds, organotitanium compounds, and silane coupling agents. The silane coupling agents are used for the surface treatment of the inorganic particles as described above, but may be further added as an additive to the undercoat layer.

Examples of the silane coupling agents used as an additive include vinyltrimethoxysilane, 3-methacryloxypropyltris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butyrate, diethylacetoacetate aluminum diisopropylate, and aluminum tris(ethylacetoacetate).

These additives may be used alone or as a mixture or polycondensate of plural compounds.

The undercoat layer preferably has a Vickers hardness of 35 or more.

In order to suppress moire images, the surface roughness (ten-point average roughness) of the undercoat layer is preferably adjusted to be in the range of from 1/(4n) (where n represents the refractive index of the overlying layer) to ½ of the wavelength λ of the exposure laser used.

In order to adjust the surface roughness, resin particles and the like may be added to the undercoat layer. Examples of the resin particles include silicone resin particles and crosslinked polymethyl methacrylate resin particles. The surface of the undercoat layer may be polished to adjust the surface roughness. Examples of the polishing method include buff polishing, sand blasting, wet honing, and grinding.

The method for forming the undercoat layer is not particularly limited, and any known method is employed. For example, a coating film of a coating liquid for forming an undercoat layer, the coating liquid being prepared by adding the above components to a solvent, is formed, and the resulting coating film is dried and, if necessary, heated.

Examples of the solvent used for preparing the coating liquid for forming an undercoat layer include publicly known organic solvents such as alcohol solvents, aromatic hydrocarbon solvents, halogenated hydrocarbon solvents, ketone solvents, ketone alcohol solvents, ether solvents, and ester solvents.

Specific examples of the solvent include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the method for dispersing inorganic particles in preparing the coating liquid for forming an undercoat layer include publicly known methods that use a roll mill, a ball mill, a vibrating ball mill, an attritor, a sand mill, a colloid mill, a paint shaker, or the like.

Examples of the method for applying the coating liquid for forming an undercoat layer to the conductive substrate include common methods such as a blade coating method, a wire bar coating method, a spray coating method, a dip coating method, a bead coating method, an air knife coating method, and a curtain coating method.

The thickness of the undercoat layer is, for example, preferably set within the range of 15 μm or more, more preferably 20 μm or more and 50 μm or less.

Intermediate Layer

An intermediate layer may be further disposed between the undercoat layer and the photosensitive layer, although not illustrated in the drawing.

The intermediate layer is, for example, a layer that contains a resin. Examples of the resin used in the intermediate layer include polymer compounds such as acetal resins (e.g., polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer that contains an organometallic compound. Examples of the organometallic compound used in the intermediate layer include organometallic compounds containing a metal atom such as zirconium, titanium, aluminum, manganese, or silicon.

These compounds used in the intermediate layer may be used alone or as a mixture or polycondensate of plural compounds.

In particular, the intermediate layer may be a layer that contains an organometallic compound containing zirconium atoms or silicon atoms.

The method for forming the intermediate layer is not particularly limited, and any known method is employed. For example, a coating film of a coating liquid for forming an intermediate layer, the coating liquid being prepared by adding the above components to a solvent, is formed, and the resulting coating film is dried and, if necessary, heated.

Examples of the application method for forming the intermediate layer include common methods such as a dip coating method, a lift coating method, a wire bar coating method, a spray coating method, a blade coating method, a knife coating method, and a curtain coating method.

The thickness of the intermediate layer is, for example, preferably set within the range of 0.1 μm or more and 3 μm or less. The intermediate layer may be used as the undercoat layer.

Charge Generation Layer

The charge generation layer is, for example, a layer that contains a charge-generating material and a binder resin. The charge generation layer may be a layer formed by vapor deposition of a charge-generating material. Such a layer formed by vapor deposition of a charge-generating material is suitable when an incoherent light source such as a light emitting diode (LED) or an organic electro-luminescence (EL) image array is used.

Examples of the charge-generating material include azo pigments such as bisazo and trisazo pigments, fused-ring aromatic pigments such as dibromoanthanthrone, perylene pigments, pyrrolopyrrole pigments, phthalocyanine pigments, zinc oxide, and trigonal selenium.

For laser exposure in the near-infrared region, of these, a metal phthalocyanine pigment or a metal-free phthalocyanine pigment is preferably used as the charge-generating material. Specifically, more preferred materials are, for example, hydroxygallium phthalocyanines disclosed in Japanese Unexamined Patent Application Publication Nos. 5-263007 and 5-279591; chlorogallium phthalocyanine disclosed in Japanese Unexamined Patent Application Publication No. 5-98181; dichlorotin phthalocyanines disclosed in Japanese Unexamined Patent Application Publication Nos. 5-140472 and 5-140473; and titanyl phthalocyanine disclosed in Japanese Unexamined Patent Application Publication No. 4-189873.

On the other hand, for laser exposure in the near-ultraviolet region, for example, a fused-ring aromatic pigment such as dibromoanthanthrone; a thioindigo pigment; a porphyrazine compound; zinc oxide; trigonal selenium; or any of the bisazo pigments disclosed in Japanese Unexamined Patent Application Publication Nos. 2004-78147 and 2005-181992 is preferably used as the charge-generating material.

When an incoherent light source, such as an LED or organic EL image array having an emission center wavelength in the range of 450 nm or more and 780 nm or less, is used, the charge-generating material described above may be used. However, from the viewpoint of the resolution, when the photosensitive layer is used in the form of a thin film having a thickness of 20 μm or less, the electric field strength in the photosensitive layer is increased, and a charge reduction due to charge injection from the substrate, that is, an image defect referred to as a "black spot" easily occurs. This becomes noticeable when a p-type semiconductor, which easily produces a dark current, such as trigonal selenium or a phthalocyanine pigment, is used as the charge-generating material.

In contrast, when an n-type semiconductor, such as a fused-ring aromatic pigment, a perylene pigment, or an azo pigment, is used as the charge-generating material, a dark current is unlikely to generate, and an image defect referred to as a black spot is suppressed even in the case of a thin film. Examples of n-type charge-generating materials include, but are not limited to, compounds (CG-1) to (CG-27) disclosed in paragraphs [0288] to [0291] of Japanese Unexamined Patent Application Publication No. 2012-155282.

Whether the n-type or not is determined on the basis of the polarity of a flowing photocurrent by a time-of-flight method that is commonly used. A material which allows electrons to flow more easily than holes as carriers is determined as the n-type.

The binder resin used in the charge generation layer is selected from a wide range of insulating resins. Alternatively, the binder resin may be selected from organic photoconductive polymers, such as poly-N-vinylcarbazole, polyvinyl anthracene, polyvinyl pyrene, and polysilane.

Examples of the binder resin include polyvinyl butyral resins, polyarylate resins (e.g., polycondensates of bisphenols and divalent aromatic carboxylic acids), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinylpyrrolidone resins. Herein, "insulating" means that the volume resistivity is $10^{13}$ Ω·cm or more.

These binder resins are used alone or as a mixture of two or more thereof.

The blend ratio of the charge-generating material to the binder resin is preferably in the range of from 10:1 to 1:10 in terms of mass ratio.

The charge generation layer may contain other known additives.

The method for forming the charge generation layer is not particularly limited, and any known method is employed. For example, a coating film of a coating liquid for forming a charge generation layer, the coating liquid being prepared by adding the above components to a solvent, is formed, and the resulting coating film is dried and, if necessary, heated. The charge generation layer may be formed by vapor deposition of a charge-generating material. The formation of the charge generation layer by vapor deposition is particularly suitable for the case where a fused-ring aromatic pigment or a perylene pigment is used as the charge-generating material.

Examples of the solvent used for preparing the coating liquid for forming a charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used alone or as a mixture of two or more thereof.

Examples of the method for dispersing particles (for example, the charge-generating material) in the coating liquid for forming a charge generation layer include methods using a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer. Examples of the high-pressure homogenizer include a collision-type homogenizer in which a dispersion is dispersed through liquid-liquid collision or liquid-wall collision in a high-pressure state, and a penetration-type homogenizer in which a dispersion is dispersed by causing the dispersion to penetrate through a fine flow path in a high-pressure state.

In the case of this dispersion, it is effective to adjust the average particle size of the charge-generating material in the coating liquid for forming a charge generation layer to 0.5 μm or less, preferably 0.3 μm or less, more preferably or 0.15 μm or less.

Examples of the method for applying the coating liquid for forming a charge generation layer to the undercoat layer (or the intermediate layer) include common methods such as a blade coating method, a wire bar coating method, a spray coating method, a dip coating method, a bead coating method, an air knife coating method, and a curtain coating method.

The thickness of the charge generation layer is, for example, preferably set within the range of 0.1 μm or more and 5.0 μm or less, more preferably 0.2 μm or more and 2.0 μm or less.

Charge Transport Layer

The charge transport layer is, for example, a layer that contains a charge-transporting material and a binder resin. The charge transport layer may be a layer that contains a polymer charge-transporting material.

Examples of the charge-transporting material include electron-transporting compounds such as quinone compounds, e.g., p-benzoquinone, chloranil, bromanil, and anthraquinone; tetracyanoquinodimethane compounds; fluorenone compounds, e.g., 2,4,7-trinitrofluorenone; xanthone compounds; benzophenone compounds; cyanovinyl compounds; and ethylene compounds. Other examples of the charge-transporting material include hole-transporting compounds such as triarylamine compounds, benzidine compounds, aryl alkane compounds, aryl-substituted ethylene compounds, stilbene compounds, anthracene compounds, and hydrazone compounds. These charge-transporting materials are used alone or in combination of two or more thereof. However, the charge-transporting material is not limited to these.

From the viewpoint of charge mobility, the charge-transporting material is preferably a triarylamine derivative represented by structural formula (a-1) below or a benzidine derivative represented by structural formula (a-2) below.

(a-1)

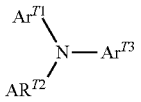

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$ where $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent for each of the groups described above include halogen atoms, alkyl groups having 1 to 5 carbon atoms, and alkoxy groups having 1 to 5 carbon atoms. Examples of the substituent for each of the groups described above further include substituted amino groups substituted with an alkyl group having 1 to 3 carbon atoms.

(a-2)

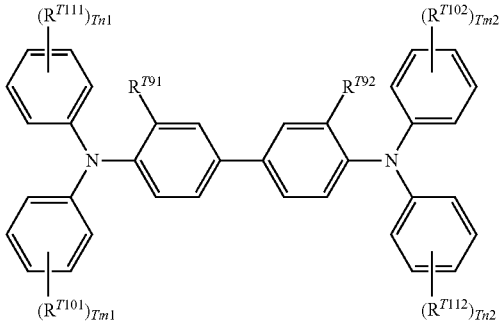

In structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms; $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$ where $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 or more and 2 or less.

Examples of the substituent for each of the groups described above include halogen atoms, alkyl groups having 1 to 5 carbon atoms, and alkoxy groups having 1 to 5 carbon atoms. Examples of the substituent for each of the groups described above further include substituted amino groups substituted with an alkyl group having 1 to 3 carbon atoms.

Here, among the triarylamine derivatives represented by structural formula (a-1) and the benzidine derivatives represented by structural formula (a-2), in particular, a triarylamine derivative having $—C_6H_4—CH=CH—CH=C(R^{T7})(R^{T8})$ and a benzidine derivative having $—CH=CH—CH=C(R^{T15})(R^{T16})$ are preferred from the viewpoint of charge mobility.

A publicly known polymer material having a charge-transporting property, such as poly-N-vinylcarbazole or polysilane is used as the polymer charge-transporting material. In particular, polyester polymer charge-transporting materials disclosed in Japanese Unexamined Patent Application Publication Nos. 8-176293 and 8-208820 are preferred. The polymer charge-transporting material may be used alone or in combination with a binder resin.

Examples of the binder resin used in the charge transport layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Of these, a polycarbonate resin or a polyarylate resin is suitable as the binder resin. These binder resins are used alone or in combination of two or more thereof.

The blend ratio of the charge-transporting material to the binder resin is preferably in the range of from 10:1 to 1:5 in terms of mass ratio.

The charge transport layer may further contain other known additives.

The method for forming the charge transport layer is not particularly limited, and any known method is employed. For example, a coating film of a coating liquid for forming a charge transport layer, the coating liquid being prepared by adding the above components to a solvent, is formed, and the resulting coating film is dried and, if necessary, heated.

Examples of the solvent used for preparing the coating liquid for forming a charge transport layer include common organic solvents such as aromatic hydrocarbons, e.g., benzene, toluene, xylene, and chlorobenzene; ketones, e.g., acetone and 2-butanone; halogenated aliphatic hydrocarbons, e.g., methylene chloride, chloroform, and ethylene chloride; and cyclic or linear ethers, e.g., tetrahydrofuran and ethyl ether. These solvents are used alone or as a mixture of two or more thereof.

Examples of the method for applying the coating liquid for forming a charge transport layer to the charge generation layer include common methods such as a blade coating method, a wire bar coating method, a spray coating method, a dip coating method, a bead coating method, an air knife coating method, and a curtain coating method.

The thickness of the charge transport layer is, for example, preferably set within the range of 5 μm or more and 50 μm or less, more preferably 10 μm or more and 30 μm or less.

Protective Layer

A protective layer is optionally disposed on a photosensitive layer. The protective layer is formed, for example, in order to prevent the photosensitive layer from being chemically changed during charging and to further improve the mechanical strength of the photosensitive layer.

Therefore, the protective layer may be a layer formed of a cured film (crosslinked film). Examples of such a layer include layers described in (1) and (2) below.

(1) A layer formed of a cured film of a composition that contains a reactive-group-containing charge-transporting material having a reactive group and a charge-transporting skeleton in the same molecule (that is, a layer that contains a polymer or crosslinked product of the reactive-group-containing charge-transporting material).

(2) A layer formed of a cured film of a composition that contains a non-reactive charge-transporting material, and a reactive-group-containing non-charge transporting material that does not have a charge-transporting skeleton but has a reactive group (that is, a layer that contains the non-reactive charge transporting material and a polymer or crosslinked product of the reactive-group-containing non-charge transporting material).

Examples of the reactive group contained in the reactive-group-containing charge-transporting material include known reactive groups such as chain-polymerizable groups, an epoxy group, —OH, —OR (where R represents an alkyl group), —$NH_2$, —SH, —COOH, and —$SiR^{Q1}{}_{3-Qn}(OR^{Q2})_{Qn}$ (where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3).

The chain-polymerizable group may be any radical-polymerizable functional group and is, for example, a functional group having a group that contains at least a carbon double bond. Specifically, an example thereof is a group that contains at least one selected from a vinyl group, a vinyl ether group, a vinyl thioether group, a vinylphenyl group, an acryloyl group, a methacryloyl group, and derivatives thereof. Of these, the chain-polymerizable group is preferably a group that contains at least one selected from a vinyl group, a vinylphenyl group, an acryloyl group, a methacryloyl group, and derivatives thereof in view of good reactivity.

The charge-transporting skeleton of the reactive-group-containing charge-transporting material may be any known structure used in an electrophotographic photoreceptor. Examples of the charge-transporting skeleton include skeletons that are derived from nitrogen-containing hole-transporting compounds, such as triarylamine compounds, benzidine compounds, and hydrazone compounds, and that have a structure conjugated with a nitrogen atom. Of these, a triarylamine skeleton is preferred.

The reactive-group-containing charge-transporting material that has a reactive group and a charge-transporting skeleton, the non-reactive charge-transporting material, and the reactive-group-containing non-charge transporting material may be selected from known materials.

The protective layer may further contain other known additives.

The method for forming the protective layer is not particularly limited, and any known method is employed. For example, a coating film of a coating liquid for forming a protective layer, the coating liquid being prepared by adding the above components to a solvent, is formed, and the resulting coating film is dried and, if necessary, subjected to a curing treatment such as heating.

Examples of the solvent used for preparing the coating liquid for forming a protective layer include aromatic solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethyl ether; and alcohol solvents such as isopropyl alcohol and butanol. These solvents are used alone or as a mixture of two or more thereof.

The coating liquid for forming a protective layer may be a solvent-free coating liquid.

Examples of the method for applying the coating liquid for forming a protective layer to the photosensitive layer (for example, the charge transport layer) include common methods such as a dip coating method, a lift coating method, a wire bar coating method, a spray coating method, a blade coating method, a knife coating method, and a curtain coating method.

The thickness of the protective layer is, for example, preferably set within the range of 1 μm or more and 20 μm or less, more preferably 2 μm or more and 10 μm or less.

Single-Layer-Type Photosensitive Layer

The single-layer-type photosensitive layer (charge generation/charge transport layer) is, for example, a layer that contains a charge-generating material, a charge-transporting material, and, optionally, a binder resin and other known additives. These materials are the same as those described in relation to the charge generation layer and the charge transport layer.

The content of the charge-generating material in the single-layer-type photosensitive layer may be 0.1% by mass or more and 10% by mass or less, and is preferably 0.8% by mass or more and 5% by mass or less relative to the total solid content. The content of the charge-transporting material in the single-layer-type photosensitive layer may be 5% by mass or more and 50% by mass or less relative to the total solid content.

The method for forming the single-layer-type photosensitive layer is the same as the method for forming the charge generation layer and the charge transport layer.

The thickness of the single-layer-type photosensitive layer may be, for example, 5 μm or more and 50 μm or less and is preferably 10 μm or more and 40 μm or less.

Image Forming Apparatus (and Process Cartridge)

An image forming apparatus according to an exemplary embodiment includes an electrophotographic photoreceptor, a charging unit that charges a surface of the electrophotographic photoreceptor, an electrostatic latent image forming unit that forms an electrostatic latent image on the charged surface of the electrophotographic photoreceptor, a developing unit that develops the electrostatic latent image formed on the surface of the electrophotographic photoreceptor by using a developer that contains a toner to form a toner image, and a transfer unit that transfers the toner image onto a surface of a recording medium. The electrophotographic photoreceptor according to the exemplary embodiment described above is used as the electrophotographic photoreceptor.

The image forming apparatus according to the exemplary embodiment is applied to a known image forming apparatus. Examples thereof include an apparatus including a fixing unit that fixes a toner image transferred onto the surface of a recording medium; a direct transfer-type apparatus in which a toner image formed on the surface of an electrophotographic photoreceptor is directly transferred onto a recording medium; an intermediate transfer-type apparatus in which a toner image formed on the surface of an electrophotographic photoreceptor is first transferred to a surface of an intermediate transfer body and the toner image transferred to the surface of the intermediate transfer body is then second transferred to a surface of a recording medium; an apparatus including a cleaning unit that cleans the surface of an electrophotographic photoreceptor after transfer of a toner image and before charging; an apparatus including a charge-erasing unit that erases charges on the surface of an electrophotographic photoreceptor by applying charge-erasing light after transfer of a toner image and before charging; and an apparatus including an electrophotographic photoreceptor heating member that increases the temperature of an electrophotographic photoreceptor to reduce the relative temperature.

In the intermediate transfer-type apparatus, the transfer unit includes, for example, an intermediate transfer body having a surface onto which a toner image is to be transferred, a first transfer unit that performs first transfer of the toner image formed on the surface of an electrophotographic photoreceptor onto the surface of the intermediate transfer body, and a second transfer unit that performs second transfer of the toner image transferred to the surface of the intermediate transfer body onto a surface of a recording medium.

The image forming apparatus according to the exemplary embodiment may be an image forming apparatus with a dry development system or an image forming apparatus with a wet development system (development system using a liquid developer).

In the image forming apparatus according to the exemplary embodiment, for example, a part that includes the electrophotographic photoreceptor may be configured as a cartridge structure (process cartridge) that is detachably attachable to the image forming apparatus. For example, a process cartridge including the electrophotographic photoreceptor according to the exemplary embodiment is suitably used as the process cartridge. The process cartridge may include, in addition to the electrophotographic photoreceptor, for example, at least one selected from the group consisting of a charging unit, an electrostatic latent image forming unit, a developing unit, and a transfer unit.

Examples of the image forming apparatus according to the exemplary embodiment will be described below but are not limited thereto. Only relevant parts illustrated in the drawings are described, and the description of other parts is omitted.

Figure 2:
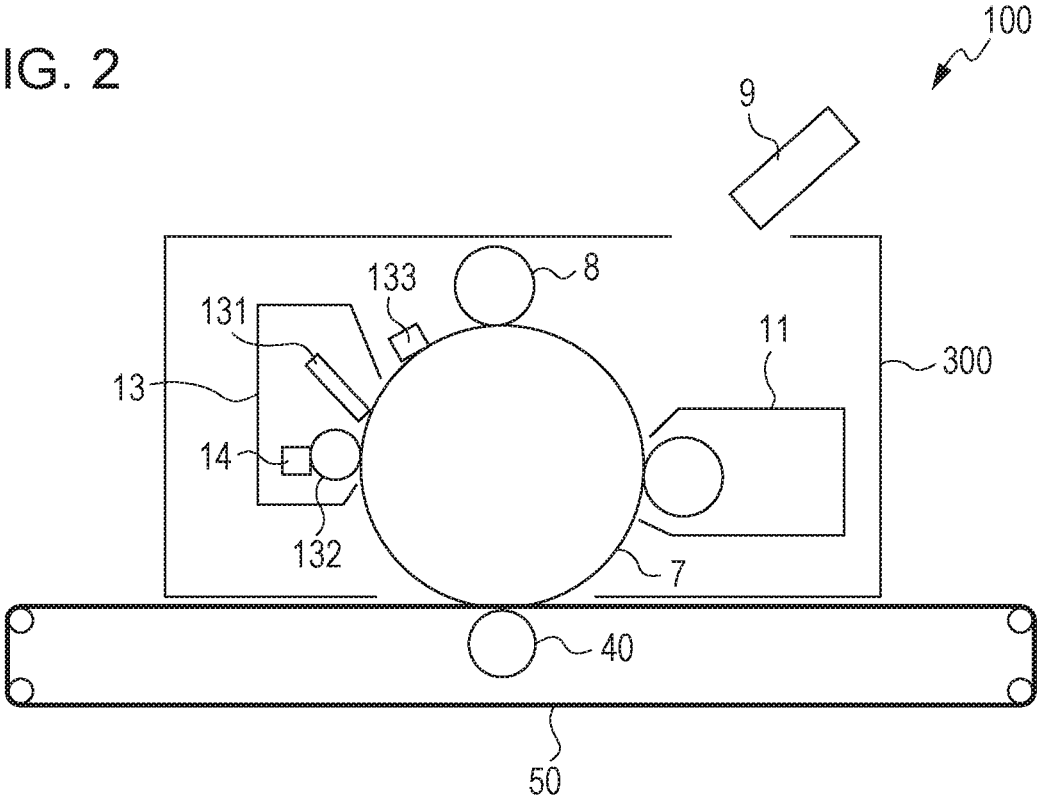
FIG. 2 is a schematic diagram illustrating an example of an image forming apparatus according to an exemplary embodiment.

FIG. 2 is a schematic diagram illustrating an example of an image forming apparatus according to the exemplary embodiment.

As illustrated in FIG. 2, an image forming apparatus 100 according to the exemplary embodiment includes a process cartridge 300 including an electrophotographic photoreceptor 7, an exposure device 9 (one example of an electrostatic latent image forming unit), a transfer device 40 (first transfer device), and an intermediate transfer body 50. In the image forming apparatus 100, the exposure device 9 is arranged at a position such that the exposure device 9 applies light to the electrophotographic photoreceptor 7 through an opening in the process cartridge 300. The transfer device 40 is arranged at a position facing the electrophotographic photoreceptor 7 with the intermediate transfer body 50 therebetween. The intermediate transfer body 50 is arranged such that a part of the intermediate transfer body 50 is in contact with the electrophotographic photoreceptor 7. The image forming apparatus 100 further includes a second transfer device (not illustrated) that transfers a toner image transferred to the intermediate transfer body 50 onto a recording medium (for example, a paper sheet). The intermediate transfer body 50, the transfer device 40 (first transfer device), and the second transfer device (not illustrated) correspond to examples of the transfer unit.

The process cartridge 300 in FIG. 2 includes a housing in which the electrophotographic photoreceptor 7, a charging device 8 (one example of a charging unit), a developing device 11 (one example of a developing unit), and a cleaning device 13 (one example of a cleaning unit) are integrally supported. The cleaning device 13 includes a cleaning blade 131 (one example of a cleaning member). The cleaning blade 131 is arranged to come in contact with a surface of the electrophotographic photoreceptor 7. The cleaning member is not limited to the cleaning blade 131. Alternatively, the cleaning member may be a conductive or insulating fibrous member. The conductive or insulating fibrous member may be used alone or in combination with the cleaning blade 131.

FIG. 2 illustrates an example of an image forming apparatus including a fibrous member 132 (roll-shaped) that supplies a lubricant 14 onto the surface of the electrophotographic photoreceptor 7, and a fibrous member 133 (flat brush-shaped) that assists cleaning. These members are arranged as required.

Structures of the components of the image forming apparatus according to the exemplary embodiment will now be described.

Charging Device

Examples of the charging device 8 include contact-type chargers that use, for example, conductive or semi-conductive charging rollers, charging brushes, charging films, charging rubber blades, or charging tubes. Non-contact-type roller chargers, and publicly known chargers such as scorotron chargers and corotron chargers that use corona discharge are also used.

Exposure Device

An example of the exposure device 9 is an optical device that exposes the surface of the electrophotographic photoreceptor 7 to light such as semiconductor laser light, LED light, liquid crystal shutter light, or the like so as to form a predetermined image pattern on the surface. The wavelength of the light source is within the spectral sensitivity range of the electrophotographic photoreceptor. Semiconductor lasers that are mainly used are near-infrared lasers having an oscillation wavelength of about 780 nm. However, the wavelength is not limited to this, and a laser having an oscillation wavelength on the order of 600 nm or a blue laser having an oscillation wavelength of 400 nm or more and 450 nm or less may also be used. In order to form color images, a surface-emitting laser light source capable of outputting a multibeam is also effective.

Developing Device

An example of the developing device 11 is a typical developing device that performs development by using a developer in a contact or non-contact manner. The developing device 11 is not limited as long as the device has the above function, and is selected in accordance with the purpose. An example thereof is a publicly known developing device having a function of causing a one-component developer or a two-component developer to adhere to the electrophotographic photoreceptor 7 with a brush, a roller, or the like. In particular, a developing device including a developing roller that carries the developer on the surface thereof may be used.

The developer used in the developing device 11 may be a one-component developer containing a toner alone or a two-component developer containing a toner and a carrier. The developer may be magnetic or nonmagnetic. Known developers may be used as these developers.

Cleaning Device

A cleaning blade-type device including the cleaning blade 131 is used as the cleaning device 13.

Instead of the cleaning blade-type device, a fur brush cleaning-type device or a simultaneous development cleaning-type device may be employed.

Transfer Device

Examples of the transfer device 40 include contact-type transfer chargers that use, for example, belts, rollers, films, or rubber blades, and publicly known transfer chargers such as scorotron transfer chargers and corotron transfer chargers that use corona discharge.

Intermediate Transfer Body

The intermediate transfer body 50 used is a belt-shaped member (intermediate transfer belt) containing a polyimide, polyamide-imide, polycarbonate, polyarylate, polyester, rubber, or the like that is imparted with semiconductivity. The form of the intermediate transfer body used may be a drum shape instead of the belt shape.

Figure 3:
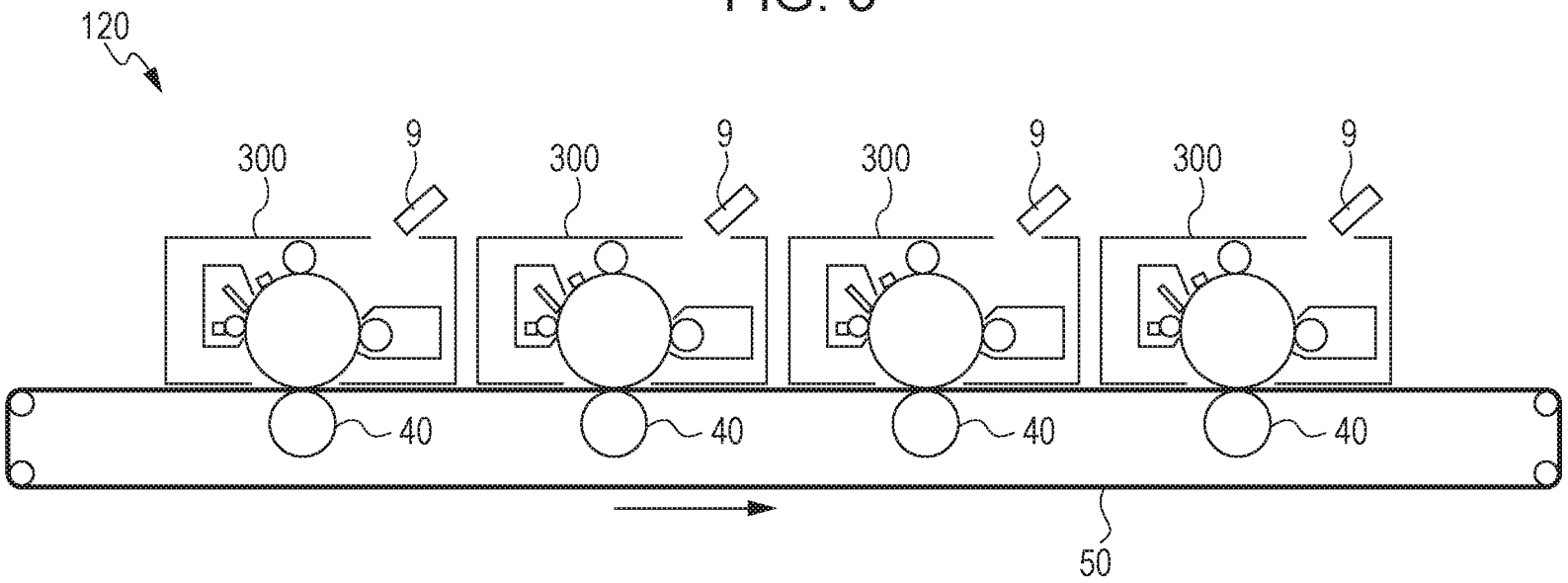
FIG. 3 is a schematic diagram illustrating another example of the image forming apparatus according to the exemplary embodiment.

FIG. 3 is a schematic diagram illustrating another example of the image forming apparatus according to the exemplary embodiment.

An image forming apparatus 120 illustrated in FIG. 3 is a tandem-system multicolor image forming apparatus including four process cartridges 300. In the image forming apparatus 120, the four process cartridges 300 are arranged in parallel on an intermediate transfer body 50, and one electrophotographic photoreceptor is used for one color. The image forming apparatus 120 has the same configuration as the image forming apparatus 100 except for the tandem system.

EXAMPLES

Examples of the present disclosure will now be described, but the present disclosure is not limited to the examples described below. In the description below, "part" and "%" are on a mass basis unless otherwise noted.

(A) Specific Fluorine-Based Graft Polymer

(Synthesis Example 1) Synthesis of Macromonomer (2-19)

[Synthesis of Precursor of Structural Unit Represented by Formula (2-19)]

To a glass flask equipped with a stirrer, a reflux condenser, a thermometer, and a nitrogen gas inlet, a mixed solution of 105.5 parts by mass of butyl acetate, 100 parts by mass of methyl methacrylate, 1.75 parts by mass of 3-mercaptopropionic acid, and 1 part by mass of 2,2'-azobis(isobutyronitrile) is continuously added dropwise over a period of four hours at 80° C. or higher and 85° C. or lower while nitrogen gas is introduced, thus conducting polymerization. Subsequently, the resulting reaction solution is heated at the same temperature for two hours and then heated at 95° C. for one hour to terminate the polymerization.

Subsequently, 3 parts by mass of glycidyl methacrylate, 0.6 parts by mass of tetra-n-butylammonium bromide, and 0.03 parts by mass of hydroquinone monomethyl ether are added, and the resulting reaction solution is allowed to react at a reaction temperature of 95° C. for eight hours. The reaction solution is returned to room temperature (25° C.) and then poured into 700 parts by mass of hexane under stirring to precipitate a solid. The solid is collected by filtration, and 200 parts by mass of methanol is added to the solid. The solid is washed under stirring, and then filtered and dried under vacuum to obtain 97 parts by mass of a macromonomer (2-19). The macromonomer has a weight-average molecular weight of 11,000 and a number-average molecular weight of 6,000 in terms of polystyrene as measured by GPC. The macromonomer (2-19) is a precursor of the structural unit represented by formula (2-19) and listed as a specific example of the structural unit represented by general formula (2).

Macromonomers which are precursors of the structural units represented by formulae (2-1) to (2-18) and (2-20) to (2-25) are synthesized as in the macromonomer which is a precursor of the structural unit represented by formula (2-19).

(Synthesis Example 2) Synthesis of Specific Fluorine-Based Graft Polymer (A-19)

To a glass flask equipped with a stirrer, a reflux condenser, a thermometer, and a nitrogen gas inlet, a mixed solution of 100 parts by mass of methyl isobutyl ketone, 25.4 parts by mass of a monomer (1-16) (a precursor of the structural unit represented by formula (1-16)), 73.0 parts by mass of the macromonomer (2-19), 1.6 parts by mass of a monomer (3-3) (a precursor of the structural unit represented by formula (3-3)), and 0.67 parts by mass of 2,2'-azobis(isobutyronitrile) is continuously added dropwise over a period of four hours at 85° C. while nitrogen gas is introduced, thus conducting polymerization. Subsequently, the resulting reaction solution is heated at the same temperature for two hours and then heated at 95° C. for one hour to terminate the polymerization. The reaction solution is returned to room temperature (25° C.) and then poured into 700 parts by mass of hexane under stirring to precipitate a solid. The solid is collected by filtration, and 200 parts by mass of methanol is added to the solid. The solid is washed under stirring, and then filtered and dried under vacuum to obtain 95 parts by mass of a specific fluorine-based graft polymer (A-19). The specific fluorine-based graft polymer (A-19) has a weight-average molecular weight of 150,000 and a number-average molecular weight of 45,000 in terms of polystyrene as measured by GPC. According to the measurement of the acid value, the specific fluorine-based graft polymer (A-19) has an acid value of 4.55 mgKOH/g.

Specific fluorine-based graft polymers (A-1) to (A-18) and (A-20) to (A-22) are synthesized as in the specific fluorine-based graft polymer (A-19).

(B) Fluorine-Containing Resin Particles

Fluorine-containing resin particles (B-1) are produced as follows.

In an autoclave, 3 L of deionized water, 3.0 g of ammonium perfluorooctanoate, and 120 g of paraffin wax (manufactured by Nippon Oil Corporation) serving as an emulsion stabilizer are charged. The inside of the system is purged with nitrogen three times and with tetrafluoroethylene (TFE) twice to remove oxygen. Subsequently, the internal pressure is adjusted to 1.0 MPa with TFE, and the internal temperature is maintained at 70° C. while stirring at 250 rpm. Next, ethane serving as a chain transfer agent in an amount equivalent to 150 cc at normal pressure and 20 mL of an aqueous solution prepared by dissolving 300 mg of ammonium persulfate serving as a polymerization initiator are charged into the system, and the reaction is started. During the reaction, the temperature inside the system is maintained at 70° C., and TFE is continuously supplied such that the internal pressure of the autoclave is constantly maintained at 1.0±0.05 MPa. When the amount of TFE consumed by the reaction after the addition of the initiator reaches 1,000 g, the supply of TFE and stirring are stopped, and the reaction is terminated. Subsequently, particles are centrifugally separated. Furthermore, 400 parts by mass of methanol is added, and the particles are washed for 10 minutes with a stirrer at 250 rpm while applying ultrasonic waves. The supernatant is filtered. This operation is repeated three times, and the substance obtained by the filtration is dried at a reduced pressure at 60° C. for 17 hours.

Through the steps described above, fluorine-containing resin particles (B-1) are produced.

The fluorine-containing resin particles (B-1) produced as described above are PTFE particles having an average primary particle size of 0.21 μm, an average secondary particle size of 5.0 μm, a BET specific surface area of 10 $m^2/g$, an apparent density of 0.40 g/mL, and a melting temperature of 328° C.

In the fluorine-containing resin particles (B-1), the number of carboxy groups per $10^6$ carbon atoms is 7, and the amount of perfluorooctanoic acid relative to the whole fluorine-containing resin particles is 5 ppb on a mass basis.

The following particles are prepared as fluorine-containing resin particles (B-2) to (B-6).

B-2: Fluon PTFE L172JE (AGC Inc.), PTFE particles, average primary particle size: 0.3 μm, melting temperature: 330° C.

B-3: Fluon PTFE L173JE (AGC Inc.), PTFE particles, average primary particle size: 0.3 μm, melting temperature: 330° C.

B-4: TLP 10F-1 (Chemours-Mitsui Fluoroproducts Co., Ltd.), PTFE particles, average primary particle size: 0.2 μm B-5: KTL-500F (Kitamura Limited), PTFE particles, average primary particle size: 0.6 μm B-6: Dyneon TF9201Z (3M), PTFE particles, average primary particle size: 0.2 μm Fluorine-containing resin particles (B-7) are produced as follows.

In a barrier nylon bag, 100 parts by mass of a commercially available homo-polytetrafluoroethylene fine powder (standard specific gravity measured in accordance with ASTM D 4895 (2004): 2.175) and 2.4 parts by mass of ethanol serving as an additive are placed. Subsequently, 150 kGy of cobalt-60 γ rays are applied at room temperature in air to obtain a low-molecular-weight polytetrafluoroethylene powder. The resulting powder is pulverized to obtain fluorine-containing resin particles (B-7).

The fluorine-containing resin particles (B-7) produced as described above are PTFE particles having an average secondary particle size of 3.5 μm and a melting temperature of 328° C.

In the fluorine-containing resin particles (B-7), the number of carboxy groups per $10^6$ carbon atoms is 75, and the amount of perfluorooctanoic acid relative to the whole fluorine-containing resin particles is 200 ppb on a mass basis.

Example 1

One hundred parts by mass of zinc oxide (average primary particle size: 70 nm, manufactured by TAYCA CORPORATION, specific surface area: 15 $m^2/g$) is mixed with 500 parts by mass of methanol under stirring, 1.25 parts by mass of KBM603 (manufactured by Shin-Etsu Chemical Co., Ltd.) serving as a silane coupling agent is added thereto, and the resulting mixture is stirred for two hours. Subsequently, the methanol is distilled off by vacuum distillation, and baking is performed at 120° C. for three hours. Thus, zinc oxide particles having surfaces treated with the silane coupling agent are obtained.

Next, 60 parts by mass of the surface-treated zinc oxide particles having surfaces treated with the silane coupling agent, 0.6 parts by mass of alizarin, 13.5 parts by mass of a blocked isocyanate (SUMIDUR 3173 manufactured by Sumika Bayer Urethane Co., Ltd.) serving as a curing agent, 15 parts by mass of a butyral resin (S-LEC BM-1 manufactured by Sekisui Chemical Co., Ltd.), and 85 parts by mass of methyl ethyl ketone are mixed to obtain a mixed solution. Next, 38 parts by mass of this mixed solution and 25 parts by mass of methyl ethyl ketone are mixed, and the resulting mixture is dispersed for four hours in a sand mill by using glass beads having a diameter of 1 mm to obtain a dispersion liquid. To the dispersion liquid, 0.005 parts by mass of dioctyltin dilaurate serving as a catalyst and 4.0 parts by mass of silicone resin particles (TOSPEARL 145 manufactured by MOMENTIVE PERFORMANCE MATERIALS JAPAN LLC) are added to prepare a coating liquid for forming an undercoat layer. The coating liquid is applied to an aluminum substrate having a diameter of 30 mm by a dip coating method, and dried and cured at 180° C. for 40 minutes. Thus, an undercoat layer having a thickness of 25 μm is formed.

Next, a mixture containing 15 parts by mass of chlorogallium phthalocyanine crystals serving as a charge-generating material and having diffraction peaks at least at Bragg angles (2θ±0.2°) of 7.4°, 16.6°, 25.5° and 28.3° with respect to the CuKα characteristic X-rays, 10 parts by mass of a vinyl chloride-vinyl acetate copolymer (VMCH, manufactured by NUC Corporation), and 300 parts by mass of n-butyl alcohol is dispersed in a sand mill with glass beads having a diameter of 1 mm for four hours. Thus, a coating liquid for forming a charge generation layer is prepared. The coating liquid for forming a charge generation layer is applied to the undercoat layer by dip coating and dried. Thus, a charge generation layer having a thickness of 0.2 μm is formed.

Next, 0.04 parts by mass of the specific fluorine-based graft polymer (A-3) is dissolved in 2.40 parts by mass of toluene to prepare a solution. Subsequently, 1.00 part by mass of the fluorine-containing resin particles (B-1), which are tetrafluoroethylene resin particles, are added to the solution and mixed under stirring for 48 hours while a liquid temperature of 20° C. is maintained. Thus, a tetrafluoroethylene resin particle suspension (liquid A) is prepared.

Next, 5.32 parts by mass of N,N'-bis(3-methylphenyl)-N,N'-diphenylbenzidine serving as a hole-transporting material, 7.05 parts by mass of a bisphenol Z polycarbonate resin (viscosity-average molecular weight: 40,000), and 0.13 parts by mass of 2,6-di-tert-butyl-4-methylphenol serving as an antioxidant are mixed. The resulting mixture is mixed with 24 parts by mass of tetrahydrofuran and 11 parts by mass of toluene and dissolved to prepare a liquid B.

The liquid A is added to the liquid B and mixed under stirring. The resulting mixture is then subjected to a dispersion treatment four times at an increased pressure of 500 kgf/cm$^2$ by using a high-pressure homogenizer (manufactured by Yoshida Kikai Co., Ltd.) equipped with a penetration-type chamber having a fine flow path. Subsequently, a silicone oil (trade name: KP340, manufactured by Shin-Etsu Chemical Co., Ltd.) is added to the resulting dispersion such that the amount of the silicone oil is 5 ppm (on a mass basis). The resulting mixture is sufficiently stirred to prepare a coating liquid for forming a charge transport layer.

The coating liquid for forming a charge transport layer is applied to the charge generation layer by a dip coating method and dried at 135° C. for 40 minutes to form a charge transport layer having a thickness of 30 m. Thus, an electrophotographic photoreceptor is produced.

Evaluation of Coating Liquid for Forming Charge Transport Layer

Evaluation of Dispersibility in Liquid

The coating liquid for forming a charge transport layer prepared as described above is stored in a thermostatic chamber at 45° C. for one month and then diluted 10 times with tetrahydrofuran. The particle size distribution of the resulting coating liquid is measured with an LA920 laser diffraction/scattering particle size distribution analyzer manufactured by HORIBA, Ltd. More specifically, the dispersibility is evaluated in accordance with the following evaluation criteria on the basis of a ratio of particles having a particle size of 0.3 μm or less in the particle size distribution measurement results. Table 9 shows the results.

Evaluation Criteria

A: The ratio of particles having a particle size of 0.3 μm or less is 90% by number or more, and dispersibility is excellent.

B: The ratio of particles having a particle size of 0.3 μm or less is 75% by number or more and less than 90% by number, and dispersibility is good.

C: The ratio of particles having a particle size of 0.3 μm or less is 60% by number or more and less than 75% by number, and dispersibility is within a practically allowable range.

D: The ratio of particles having a particle size of 0.3 μm or less is less than 60% by number, and dispersibility is beyond a practically allowable range.

Evaluation of Charge Transport Layer

Dispersibility of Particles in Film

With regard to the photoreceptor formed on the cylindrical substrate by the dip coating method, the uniformity of particle dispersion on the surface of the charge transport layer is evaluated by visual observation. Table 9 shows the results.

Evaluation Criteria

A: No streaks are observed at all positions.

B: Slight streak-like defects are observed in portions within 5 mm from both ends with respect to the axial direction of the cylinder (photoreceptor).

C: Streak-like defects are observed in portions within 10 mm from both ends with respect to the axial direction of the cylinder (photoreceptor).

D: Streak-like defects are observed in a central portion and end portions with respect to the axial direction of the cylinder (photoreceptor).

Image Forming Evaluation Using Photoreceptor

The electrophotographic photoreceptor produced as described above is mounted on a drum cartridge and installed in an image forming apparatus ApeosPort C4300 manufactured by Fuji Xerox Co., Ltd., the image forming apparatus having a potential sensor attached thereto. A 10% halftone image is output on 10,000 sheets of A4 paper in an environment at 28° C./85%.

Evaluation of Residual Potential (One Sheet)

The residual potential of the surface of the electrophotographic photoreceptor after outputting the first sheet is measured and evaluated in accordance with the following criteria. Table 9 shows the results.

Evaluation Criteria

A: The absolute value of the residual potential is less than 50 V.

B: The absolute value of the residual potential is 50 V or more and less than 70 V.

C: The absolute value of the residual potential is 70 V or more and less than 90 V.

D: The absolute value of the residual potential is 90 V or more.

Evaluation of Difference in Residual Potential

The residual potential of the electrophotographic photoreceptor after outputting one sheet, and the residual potential of the electrophotographic photoreceptor after outputting 10,000 sheets are measured. The difference in absolute value of the residual potential (absolute value of residual potential after outputting 10,000 sheets−absolute value of residual potential after outputting one sheet) is determined and defined as a rise in the absolute value of the residual potential. The rise in the absolute value of the residual potential is evaluated in accordance with the following criteria. Table 9 shows the results.

Evaluation Criteria

A: The rise in the absolute value of the residual potential is less than 5 V.

B: The rise in the absolute value of the residual potential is 5 V or more and less than 10 V.

C: The rise in the absolute value of the residual potential is 10 V or more and less than 20 V.

D: The rise in the absolute value of the residual potential is 20 V or more.

Image Quality Evaluation

The output image on the first sheet and the output image on the 10000th sheet are observed, and image defects are evaluated. Table 9 shows the results.

Evaluation Criteria

A: No image defects are observed.

B: Slight image defects are observed under a magnifying glass but are within a practically allowable range.

C: Image defects are observed by visual inspection.

D: Image defects are observed and extend as streaks.

Examples 2 to 24

Electrophotographic photoreceptors of Examples 2 to 24 are produced as in Example 1 except that the type of specific fluorine-based graft polymer used, the type of fluorine-containing resin particles used, and the amount of specific fluorine-based graft polymer added relative to 1.00 part by mass of fluorine-containing resin particles ("mass ratio relative to particles" in the tables) are changed as shown in Tables 9 and 10.

With regard to Examples 2 to 24, the evaluation of the coating liquid for forming a charge transport layer, the evaluation of the charge transport layer, and the image forming evaluation using the photoreceptor are performed as in Example 1. Tables 9 and 10 show the results.

Comparative Examples 1 and 2

Electrophotographic photoreceptors of Comparative Examples 1 and 2 are produced as in Example 6 except that fluorine-based graft polymers shown in Table 10 are used instead of the specific fluorine-based graft polymer (A-19).

With regard to Comparative Examples 1 and 2, the evaluation of the coating liquid for forming a charge transport layer, the evaluation of the charge transport layer, and the image forming evaluation using the photoreceptor are performed as in Example 6. Table 10 shows the results.

The fluorine-based graft polymers (CA-1) and (CA-2) shown in Table 10 are fluorine-based graft polymers (CA-1) and (CA-2), respectively, described in Table 11.

TABLE 9

| | Fluorine-based graft polymer | Fluorine-containing resin particles | Mass ratio relative to particles (parts by mass) | Molar ratio of acid group to particles (mole) | Dispersibility in liquid | Dispersibility of particles in film | Residual potential (one sheet) | Difference in residual potential | Image quality (one sheet) | Image quality (10,000 sheets) |
|---|---|---|---|---|---|---|---|---|---|---|
| Example 1 | A-3 | B-1 | 0.04 | 2.17 | A | A | A | A | A | A |
| Example 2 | A-4 | B-2 | 0.04 | 4.00 | A | A | A | A | A | A |
| Example 3 | A-5 | B-3 | 0.04 | 2.53 | B | B | A | B | A | B |
| Example 4 | A-6 | B-1 | 0.04 | 2.14 | A | A | A | A | A | A |
| Example 5 | A-7 | B-5 | 0.04 | 2.45 | A | A | A | A | A | A |
| Example 6 | A-8 | B-1 | 0.04 | 2.05 | A | A | A | A | A | A |
| Example 7 | A-9 | B-6 | 0.04 | 2.23 | B | B | A | B | A | B |
| Example 8 | A-10 | B-4 | 0.04 | 2.04 | B | B | A | B | A | B |
| Example 9 | A-11 | B-1 | 0.0045 | 0.28 | A | B | B | B | B | B |
| Example 10 | A-11 | B-1 | 0.02 | 1.24 | A | A | A | A | A | A |
| Example 11 | A-11 | B-1 | 0.063 | 3.89 | A | A | A | A | A | A |
| Example 12 | A-11 | B-1 | 0.075 | 4.63 | B | B | A | B | A | B |
| Example 13 | A-12 | B-1 | 0.04 | 2.41 | A | A | A | A | A | A |
| Example 14 | A-13 | B-1 | 0.04 | 2.45 | A | A | A | A | A | A |
| Example 15 | A-14 | B-1 | 0.04 | 2.26 | A | A | A | A | A | A |

TABLE 10

| | Fluorine-based graft polymer | Fluorine-containing resin particles | Mass ratio relative to particles (parts by mass) | Molar ratio of acid group to particles (mole) | Dispersibility in liquid | Dispersibility of particles in film | Residual potential (one sheet) | Difference in residual potential | Image quality (one sheet) | Image quality (10,000 sheets) |
|---|---|---|---|---|---|---|---|---|---|---|
| Example 16 | A-15 | B-1 | 0.04 | 2.70 | B | B | A | B | A | B |
| Example 17 | A-16 | B-3 | 0.04 | 2.70 | A | A | A | A | A | A |
| Example 18 | A-17 | B-1 | 0.04 | 0.19 | A | B | A | B | A | B |
| Example 19 | A-18 | B-1 | 0.04 | 0.27 | A | B | A | A | A | B |
| Example 20 | A-19 | B-1 | 0.04 | 3.24 | A | A | A | A | A | A |
| Example 21 | A-20 | B-1 | 0.04 | 6.36 | A | A | A | A | B | A |
| Example 22 | A-21 | B-1 | 0.04 | 10.47 | A | A | A | A | B | B |
| Example 23 | A-22 | B-1 | 0.04 | 2.42 | A | A | A | A | A | A |
| Example 24 | A-11 | B-7 | 0.063 | 3.89 | B | B | A | A | B | B |
| Comparative Example 1 | CA-1 | B-1 | 0.04 | 0 | C | C | B | C | C | C |
| Comparative Example 2 | CA-2 | B-1 | 0.04 | 2.72 | D | D | C | D | D | D |

TABLE 11

| Fluorine-based graft polymer | (a) First structural unit | (b) Second structural unit | Other structural unit | Molar ratio (a) | Molar ratio (b) | Molar ratio Other | Acid value mgKOH/g | Weight-average molecular weight Mw |
|---|---|---|---|---|---|---|---|---|
| CA-1 | Formula (1-1) | Formula (2-1) | None | 0.92 | 0.08 | 0 | 0 | 80,000 |
| CA-2 | Formula (1-3) | Formula (2-6) | Formula (CA) | 0.88 | 0.07 | 0.05 | 3.82 | 70,000 |

In Tables 9 and 10, the "molar ratio of acid group to particles" means the number of moles of a specific acidic group per 1 g of fluorine-containing resin particles.

In Table 11, "Formula (CA)" represents a structural unit represented by structural formula (CA) below.

(CA)

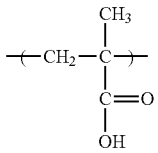

The above results show that the differences in residual potential (that is, the rises in the absolute value of the residual potential) in Examples are smaller than those in Comparative Examples, and the residual potential is reduced in Examples.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrophotographic photoreceptor comprising:

a conductive substrate; and a photosensitive layer disposed on the conductive substrate, wherein an outermost surface layer of the electrophotographic photoreceptor contains a fluorine-based graft polymer and a fluorine-containing resin particle, and the fluorine-based graft polymer includes at least a first structural unit that does not have an acidic group with a pKa of 3 or less but has a fluorine atom, a second structural unit derived from a macromonomer, and a third structural unit having the acidic group with a pKa of 3 or less.

2. The electrophotographic photoreceptor according to claim 1, wherein the acidic group with a pKa of 3 or less includes an acidic group (Ac) which is at least one selected from the group consisting of a sulfo group, a phosphate group, a phosphonate group, and a fluorinated alkyl carboxy group.

3. The electrophotographic photoreceptor according to claim 2, wherein a number of moles of the acidic group with a pKa of 3 or less per 1 g of the fluorine-containing resin particle is 0.2 μmol/g or more and 5 μmol/g or less.

4. The electrophotographic photoreceptor according to claim 2, wherein a number of moles of the acidic group (Ac) per 1 g of the fluorine-containing resin particle is 0.2 μmol/g or more and 5 μmol/g or less.

5. The electrophotographic photoreceptor according to claim 1, wherein a number of moles of the acidic group with a pKa of 3 or less per 1 g of the fluorine-containing resin particle is 0.2 μmol/g or more and 5 μmol/g or less.

6. The electrophotographic photoreceptor according to claim 1, wherein the macromonomer includes at least one selected from the group consisting of a poly(meth)acrylate having a radical-polymerizable group at one end and polystyrene having a radical-polymerizable group at one end.

7. The electrophotographic photoreceptor according to claim 1, wherein the first structural unit is a structural unit represented by general formula (1) below, the second structural unit is a structural unit represented by general formula (2) below, and the third structural unit is a structural unit represented by general formula (3) below:

(1)

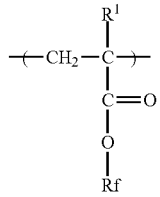

(2)

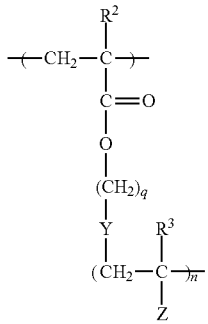

(3)

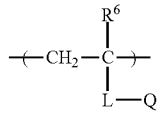

where, in general formula (1), $R^1$ represents a hydrogen atom or an alkyl group, and Rf represents an organic group having a fluorine atom; in general formula (2), n represents an integer of 2 or more, q represents an integer of 1 or more, $R^2$ and $R^3$ each independently represent a hydrogen atom or an alkyl group, Y represents a substituted or unsubstituted alkylene group, —O—, —NH—, —S—, —C(=O)—, a divalent linking group obtained by combining any of these, or a single bond, and Z represents a group represented by general formula (2A) or (2B) below; in general formula (3), L represents a substituted or unsubstituted alkylene group, —O—, —C(=O)—, —$NR^{10}$—, —$C_6H_4$—, a divalent linking group obtained by combining any of these, or a single bond, Q represents a sulfo group, a phosphonate group, a phosphate group, or a fluorinated alkyl carboxy group, and $R^6$ represents a hydrogen atom, a halogen atom, or an alkyl group; and $R^{10}$ represents a hydrogen atom or a substituted or unsubstituted alkyl group;

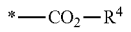

(2A)

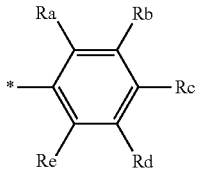

(2B)

where, in general formula (2A), $R^4$ represents a substituted or unsubstituted alkyl group or a mono- or poly-alkyleneoxy chain, and * represents a site bound to a carbon atom; and in general formula (2B), Ra to Re each independently represent a hydrogen atom, an alkyl group having 4 or less carbon atoms, or an alkoxy group having 4 or less carbon atoms, and * represents a site bound to a carbon atom.

8. The electrophotographic photoreceptor according to claim 1, wherein a content of the fluorine-based graft polymer relative to 100 parts by mass of the fluorine-containing resin particle is 0.5 parts by mass or more and 10 parts by mass or less.

9. The electrophotographic photoreceptor according to claim 1, wherein the fluorine-containing resin particle contains polytetrafluoroethylene.

10. The electrophotographic photoreceptor according to claim 1, wherein a number of carboxy groups in the fluorine-containing resin particle is 0 or more and 30 or less per $10^6$ carbon atoms.

11. The electrophotographic photoreceptor according to claim 10, wherein the number of carboxy groups in the fluorine-containing resin particle is 0 or more and 20 or less per $10^6$ carbon atoms.

12. The electrophotographic photoreceptor according to claim 1, wherein an amount of perfluorooctanoic acid relative to a mass of the fluorine-containing resin particle is 0 ppb or more and 25 ppb or less.

13. The electrophotographic photoreceptor according to claim 12, wherein the amount of perfluorooctanoic acid relative to the mass of the fluorine-containing resin particle is 0 ppb or more and 20 ppb or less.

14. The electrophotographic photoreceptor according to claim 1, wherein the outermost surface layer contains a hole-transporting material.

15. A process cartridge detachably attachable to an image forming apparatus, the process cartridge comprising:

the electrophotographic photoreceptor according to claim 1.

16. An image forming apparatus comprising:

the electrophotographic photoreceptor according to claim 1;

a charging unit that charges a surface of the electrophotographic photoreceptor;

an electrostatic latent image forming unit that forms an electrostatic latent image on the charged surface of the electrophotographic photoreceptor;

a developing unit that develops the electrostatic latent image formed on the surface of the electrophotographic photoreceptor by using a developer that contains a toner to form a toner image; and a transfer unit that transfers the toner image onto a surface of a recording medium.

17. An electrophotographic photoreceptor comprising:

a conductive substrate; and a photosensitive layer disposed on the conductive substrate, wherein an outermost surface layer of the electrophotographic photoreceptor contains a fluorine-based graft polymer and a fluorine-containing resin particle, and the fluorine-based graft polymer includes at least a first structural unit that does not have an acidic group (Ac) which is at least one selected from the group consisting of a sulfo group, a phosphate group, a phosphonate group, and a fluorinated alkyl carboxy group but has a fluorine atom, a second structural unit derived from a macromonomer, and a third structural unit having the acidic group (Ac).

18. The electrophotographic photoreceptor according to claim 17, wherein a number of moles of the acidic group (Ac) per 1 g of the fluorine-containing resin particle is 0.2 μmol/g or more and 5 μmol/g or less.

* * * * *